US007470298B2

(12) United States Patent
Berling et al.

(10) Patent No.: US 7,470,298 B2
(45) Date of Patent: Dec. 30, 2008

(54) DEVICE FOR EFFECTIVELY REMOVING SUSPENDED PARTICLES FROM AN AIRFLOW

(75) Inventors: Udo Berling, Hopsten (DE); Matthias Weibel, Hopsten (DE)

(73) Assignee: Berbel Ablufttechnik GmbH, Rheine (DE)

( * ) Notice: Subject to any disclaimer, the term of this patent is extended or adjusted under 35 U.S.C. 154(b) by 598 days.

(21) Appl. No.: 10/513,471

(22) PCT Filed: Dec. 18, 2002

(86) PCT No.: PCT/EP02/14435

§ 371 (c)(1),
(2), (4) Date: Jun. 28, 2005

(87) PCT Pub. No.: WO03/095900

PCT Pub. Date: Nov. 20, 2003

(65) Prior Publication Data

US 2006/0096257 A1 May 11, 2006

(30) Foreign Application Priority Data

May 8, 2002 (DE) ..... 202 07 549.4

(51) Int. Cl.
*B01D 50/00* (2006.01)

(52) U.S. Cl. ..... 55/320; 55/439; 55/462; 55/DIG. 36

(58) Field of Classification Search ..... 55/320, 55/434, 437, 439, 486, 462, DIG. 36
See application file for complete search history.

(56) References Cited

U.S. PATENT DOCUMENTS

| | | | | |
|---|---|---|---|---|
| 2,813,477 | A | 11/1957 | Gaylord | 98/115 |
| 2,868,108 | A | 1/1959 | Petersen | 98/115 |
| 3,065,687 | A | 11/1962 | Graswich et al. | 98/115 |
| 3,338,049 | A * | 8/1967 | Fernberger | 60/39.092 |
| 3,667,371 | A | 6/1972 | Russell | 98/115 |
| 4,124,021 | A | 11/1978 | Molitor | 126/299 |
| 4,125,148 | A | 11/1978 | Molitor | 165/2 |
| 4,129,179 | A | 12/1978 | Molitor | 165/101 |
| 4,784,114 | A | 11/1988 | Muckler et al. | 126/299 |
| 5,960,786 | A * | 10/1999 | Lambertson | 126/299 D |
| 6,079,407 | A | 6/2000 | Lai | 126/299 |

FOREIGN PATENT DOCUMENTS

| | | |
|---|---|---|
| DE | 26 50 435 | 5/1977 |
| DE | 199 60 589 | 7/2001 |
| EP | 0 703 414 | 7/1998 |
| GB | 624 853 | 11/1945 |

* cited by examiner

*Primary Examiner*—Robert A Hopkins
(74) *Attorney, Agent, or Firm*—Olson & Cepuritis, Ltd.

(57) ABSTRACT

A device for removing suspended particles from an airflow has an intake opening, an air conveying the duct, and a fan. The air conveying duct deflects the airflow with regard to its flow direction at least sectionally. In order to filter the suspended particles almost completely from the air, the airflow is guided in the air conveying duct by positive guiding elements along a general conveying direction such that the airflow is subjected to at least a twofold sequentially arranged curve-shaped deflection in different directions. The height of at least one positive guiding element projecting into the air conveying duct is smaller than the free height of the flow cross-section of the air conveying duct in the area of the positive guiding element.

37 Claims, 18 Drawing Sheets

DEVICE FOR EFFECTIVELY REMOVING SUSPENDED PARTICLES FROM AN AIRFLOW

BACKGROUND OF THE INVENTION

The invention relates to a device for effectively removing suspended particles from an airflow, wherein the device comprises an intake opening, an air conveying duct, and a suction fan, and wherein the air conveying duct deflects sectionally the airflow with regard to its flow direction. The suspended particles can be created in particular by operation of stove devices and are removed by exhaust hoods of the aforementioned kind.

In the prior art, an exhaust hood is known that is comprised of an intake chamber and an exhaust chamber wherein a grease filter arranged in an air passage comprises a cleaning device with spray nozzles for spraying and a collecting channel for collecting and discharging cleaning liquids. The conventional exhaust hood, as disclosed in EP-A-0 703 414, is characterized by an angular arrangement of the exhaust chamber about a central intake chamber, wherein above a cover plate of the intake chamber the centrally arranged spraying device with spray nozzles is arranged through which the spray nozzles are supplied with liquid in order to remove solid and liquid particles from the airflow sucked in by the conventional exhaust hood.

The conventional exhaust hood, inter alia, has the disadvantage that a continuous consumption of washing agents and solvents is not required and the supply of washing agents and solvents must be controlled and monitored by metering devices, and that moreover the spraying device is comprised of a spraying arm with spraying nozzles that is arranged to be rotatable about a vertical axis, wherein the spraying arm in operation must be rotated at all times and these movements must also be monitored at all times.

Moreover, not only the supply of washing agents and solvents must be monitored, but moreover the washing agents and solvents that are laden with solid particles and liquid particles from the sucked-in airflow must be removed as wastewater. Therefore, the exhaust hood requires separate supply devices and removal devices for the washing agents and solvents and for the washing agents and solvents in the form of waste water.

The conventional exhaust hood requires an increased expenditure with regard to service as well as with regard to spatial size of the receptacle of the conventional exhaust hood; additionally, a comprehensive monitoring and servicing of the spraying and control devices of the conventional exhaust hood is required.

In the ventilation exhaust described in DE-OS 26 504 35, which is comprised of a primary chamber arranged above the stove and a secondary chamber that communicates with the primary chamber, the sucked-in airflow is guided through a filter underneath which filter nozzles are arranged. By means of these nozzles cleaning water is sprayed into the area below a grid provided as a filter for collecting and removing solid and liquid particles removed from the airflow.

The conventional ventilation exhaust also makes necessary special devices for supplying the cleaning water and the cleaning water laden with particles as wastewater as well as for removing. Also, the conventional ventilation exhaust requires devices for operating the grid used as a filter with spray nozzles. Moreover, it has been found that the moisture of the airflow that has been laden greatly with water molecules condensates also above the filter in the secondary chamber and in the ducts for removing the airflow from the secondary chamber to the exterior outside of the room where the stove devices are located.

The precipitation of moisture from the airflow enriched with water molecules leads often to fungal growth and bacterial growth. Fungal growth and bacterial growth contribute because of their spore generation to an increased health risk of the personnel present within the room where the conventional ventilation exhaust is located.

The kitchen exhaust hood disclosed in DE-OS 199 60 589 is characterized by an aerosol separator which is arranged opposite an intake opening wherein the housing has a cylinder having a wall in which the intake opening extends in the longitudinal direction of the cylinder underneath the guide surface wherein the aerosol separator opposite the intake opening forms a longitudinal section of the wall of the cylinder and the base surfaces of the cylinder each have outlet openings for the airflow above the exit side of the passage.

The configuration of the conventional kitchen exhaust hood is very complex in order to remove suspended particles, vapor and grease droplets, dust and soot particles from the airflow.

Finally, an exhaust hood is disclosed in DE 299 18 312 that comprises a housing with back plate, side plates, and a top plate wherein the top plate has at least one outlet opening and at least one motor attached thereto. This exhaust hood comprises a passage that communicates with the outlet opening wherein the passage has connected thereto an outlet chamber. Above the intake opening, a slanted bottom plate is arranged above which a separating device is arranged. The separating device communicates with at least one nozzle that is loaded with water for generating a water curtain. The taken-in airflow flows through the water curtain for the purpose of oil removal. The removed oil is contained in a collecting device.

It has been found here also that the airflow that is highly enriched with water molecules has the tendency of condensate formation in the area of the outlet opening and in the area of the exhaust lines connected to the outlet openings. Moreover, a further disadvantage is created, in addition to the requirement for supply, removal and control of the cleaning water, in that fungal and bacterial growth occur; this is to be avoided at all costs particularly in the area of foodstuff preparation and processing.

All of the aforementioned solutions have in common the disadvantage that, despite a high constructive expenditure, they can remove only comparatively minimal proportions of suspended particles from the taken-in air. In all solutions there remain residual amounts of suspended particles in the exhaust air that will deposit in the fan and air conveying ducts and will cause stubborn soiling that can hardly be removed anymore.

SUMMARY OF THE INVENTION

It is an object of the invention to provide a compact simple device that, while requiring minimal operating and service expenditure and minimal operating costs, remove reliably a high proportion of suspended particles from the taken-in airflow.

In addition, the operation of the device should provide a low noise level in order to expose the personnel operating the stove devices to a minimal noise emission.

Also, the suspended particles removed from the taken-in airflow should be easily removable by the operating personnel.

The aforementioned objects are solved in that the airflow is guided through positive guiding means arranged in the air conveying duct in such a way along a general conveying direction that the airflow is subjected to at least a twofold sequentially occurring curve-shaped deflection in different directions and that a height of at least one positive guiding means projecting into the air conveying duct is smaller than the free height of the flow cross-section of the air conveying duct in the area of this positive guiding means. According to another configuration of the invention it is a characterizing feature that a bottom plate and a top plate are positioned at a spacing and between them the air conveying duct is formed, that the bottom plate and the top plate have at least two sequentially arranged arc-shaped curved portions that extend at least sectionally approximately parallel to one another and are oriented opposite to one another, and that the forward area of the top plate and the forward section of the bottom plate delimit an intake chamber with the intake opening.

In the device of the present invention, advantage is taken of the advantage that the gaseous components of the taken-in airflow and the suspended particles moved within the airflow have different specific densities and, accordingly, different mass moment of inertia. As a result of the positive deflection of the airflow by means of the positive guiding means, the fractions of the gaseous media and the suspended particles moved therein are accelerated or decelerated differently across the flow cross-section, and the fractions will assume different trajectories in the area of the positive guiding means. As a result of the different direction of the sequential deflections by means of the positive guiding means, the separating effect between the fractions is improved. While the suspended particles as a result of their greater mass moment of inertia have a tendency to assume a trajectory of a greater radius, the gaseous media can move on trajectories having a tighter radius in the deflection area. In the area of the first deflection, a segregation takes place such that the suspended particles will collect within the outer area of the airflow.

In addition to the segregation, a further effect is achieved in the area of the first deflection: the suction effect generated by the fan acts statistically the same across the entire flow cross-section of the air conveying duct. Since the distances traveled by the fractions moved within the airflow in the air conveying duct however have different lengths in the area of the positive guiding means, depending on whether they are located at the inner or outer radius of the deflection, they are subjected dynamically to different degrees of acceleration as a function of their movement path. While the fractions of the airflow at the inner side of the curve are accelerated to the greatest extent, the fractions that move within the outer curve area are hardly accelerated at all or even decelerated, depending on the conditions and the concrete configuration. In this connection, the acceleration differences are the greater the smaller the inner radius of the deflection is selected in relation to the free height of the flow cross-section.

The sum of these two effects causes in the area of the first deflection the following effect: while the gaseous media with great velocity are moved by suction near the inner radius of deflection through the first positive guiding means, the suspended particles at minimal movement speed are collected in the area of the outer radius of the deflection, and, as a result of their movement speed and the gravitational forces acting on the suspended particles, have the tendency to follow a trajectory whose bending radius is greater than the free radius of the air conveying duct in the area of the positive guiding means. These physical conditions lead to a great portion of the suspended particles within the airflow colliding with the outer wall of the air conveying duct and adhering thereto. Because of the comparatively minimal flow velocities in the outer radius, such suspended particles will not be removed again and entrained by the airflow; the separation of the suspended particles from the airflow is thus permanent.

However, in this zone not all suspended particles have been removed. A few suspended particles are still moved within the airflow, particularly in the outer radius of the deflection. The safe removal also of these suspended particles is realized by a second deflection in the opposite direction: the deflection in the opposite direction has the effect of an acceleration of the gaseous media that prior to this have moved slowly within the outer radius. As a result of their mass moment of inertia, the suspended particles cannot follow this acceleration. Because of the acceleration of the gaseous media that surrounded them previously, the slowly moving gas envelope becomes thinner and the faster airflows that have been moving previously within the central radius area push into the area of the gas envelope becoming thinner as a result of the acceleration. Because of these flows, the suspended particles still moving within the airflow are subjected to an impetus in the direction toward the near outer wall. As a result of this effect, even those suspended particles that could not be removed by prior art devices will collide with the outer wall and adhere thereto. In the described way, it is possible to remove 90% and more of the suspended particles moved within the airflow in the form of grease and/or water droplets.

These high removal rates can be obtained with a very minimal technical expenditure. The air conveying duct according to the invention is of a small size and has a flat configuration. The airflow is impeded only minimally so that only a comparatively minimal fan output is required. The reduced fan output reduces the operating noise and the operating costs as a result of reduced electricity consumption. The operation is simple because the exhaust hood must only be switched on and off, and no additional supply means, monitoring and servicing work of any kind is required. It is sufficient to occasionally wipe the surface of the inner wall in the area of the positive guiding means. In this connection, the surface in this area can be designed to be easy to clean. Because of the high removal rate of suspended particles, the fan, the exhaust ducts arranged downstream thereof, and, in the case of circulating operation, the room air are loaded only minimally by suspended particles that have not been removed. The cleaned airflow is also characterized by a lower contents of moisture in comparison to the airflow that is outside of the intake chamber so that neither fungal growth nor bacterial growth in the exhaust chamber or in the air conveying duct is observed. The device remains permanently clean, there are no longer hygienic stress or health hazards for the operating personnel resulting from the presence of the exhaust hood. Also, the efficiency for permanent operation of the device according to the invention remains substantially intact as a result of the sufficiently large area of the top plate and the forward section of the bottom plate providing an impact and deposition surface for the suspended particles.

For realizing the invention it may be sufficient to arrange transverse profiles that have a simple rectangular, triangular, round or other cross-section in the flow direction at a spacing to one another on opposite sides of an otherwise smooth air conveying duct. Guiding of the airflow is however accomplished preferably in an arc by means of correspondingly designed smooth inner surfaces of the air conveying duct in order to prevent disruptive stalls or turbulences by which the suspended particles could also be thrown back into the airflow. In this way, the flow resistance and the operating noise is reduced, and smooth surfaces are easier to clean. It is also advantageous to keep the air conveying duct as short as possible because in this way the configuration and the manufacturing expenditure can be kept very small. For this purpose, the intake opening is delimited by the sidewalls delimiting the air conveying duct, and the deflection zones adjoin immediately the intake opening. For such a configuration, the removal of the suspended particles is realized directly adjacent to the intake opening. The removal zone is thus easily accessible and can be cleaned easily. Also, because of the compact configuration it is possible to arrange across a working area, for example, a stove, several intake openings in any position—longitudinally, transversely, diagonally, vertically staggered, etc.—that are provided each with an adjoining air conveying duct according to the invention.

A deflection element and/or a tubular filter part can be inserted additionally into the device according to the invention for removing from the airflow the residual suspended particles, odor molecules and/or humidity from the gaseous media. The efficiency of the device is increased even more in this way. The proposed tubular filter part in this connection is able to bind a significantly larger amount of odor molecules than conventional filters so that the service life of such a tubular filter part is significantly increased.

The dependent claims concern preferred configurations and further developments of the invention.

The term suspended particles is to be understood in the context of the invention to also include, for example, vapors, grease and oil particles of larger consistency, dust particles, and/or smoke particles that are generated, for example, when operating stove devices.

The term finest particles is to be understood in the context of the invention to also include, for example, more liquid grease particles and oil particles with low-viscosity unsaturated fatty acids and vapor droplets that are generated, for example, when operating stove devices.

In the context of the invention the term vapors is to be understood to include also vapor or dense fumes that are generated when operating water kettles, when heating aqueous solutions and the like, and that, as vapor, enter the airflow to be sucked off.

The term fan is to be understood as a blower that can be operated, for example, by electric power, for conveying an airflow, wherein the device that can be operated by electric power is coupled directly to the blower or is spaced therefrom by means of a shaft.

The term gaseous media is to be understood in the context of the invention to also include, for example, gases such as air, volatile vapors of organic and/or aqueous solvents.

BREIF DESCRIPTION OF THE DRAWINGS

The invention will be explained in more detail with the aid of embodiments. The drawings show as a result of drawing simplification in a schematic, greatly enlarged way, without laying claim to a representation to scale, embodiments and further developments of the invention without limiting the invention to the embodiments. It is shown in:

FIG. 1 a perspective view of the device according to the invention with intake opening, intake chamber, air conveying duct, exhaust chamber in cross-section;

FIG. 2 the cross-section of the device according to the invention with the illustration of the course of the taken-in air masses that enter the fan chamber of the housing through the outlet opening;

FIG. 3 a perspective view from above onto the oval outlet opening of the device according to the invention;

FIG. 4 a plan view onto the rear housing part;

FIG. 5 a perspective view of the device according to the invention in cross-section with the housing that is assembled of a forward housing part with recesses for control devices and supply lines of the fan and a rear housing part;

FIG. 6 an interior view of the forward housing part;

FIG. 7 a plan view onto the forward housing part;

FIG. 8 a view at a slant from above onto the rear housing part;

FIG. 9 a slanted view onto a two-part housing with two housing parts in a folded open position;

FIG. 10 a plan view onto the deflection element according to the invention with a module 43 comprising layers of rods;

FIG. 11 a section A-A according to FIG. XI as a cross-section of the deflection element according to the invention with a module having three layers of rods, showing the spacing X as a horizontal distance between two immediately neighboring rods of a layer 41 and a spacing X as a horizontal distance between two immediately neighboring rods of a layer 42 as well as with diagonal spacing Y between rod 43 of the layer 41 and rod 43 of the layer 42;

FIG. 12 a slanted view onto the deflection element according to the invention;

FIG. 13 a plan view onto the tubular filter part according to the invention;

FIG. 14 a section A-A according to FIG. XIII as a longitudinal section of the tubular filter part according to the invention;

FIG. 15 a longitudinal section of the air-permeable walls of the tubular filter part according to the invention.

FIG. 16 an air conveying duct;

DESCRIPTION OF PREFERRED EMBODIMENTS

Figure 1:
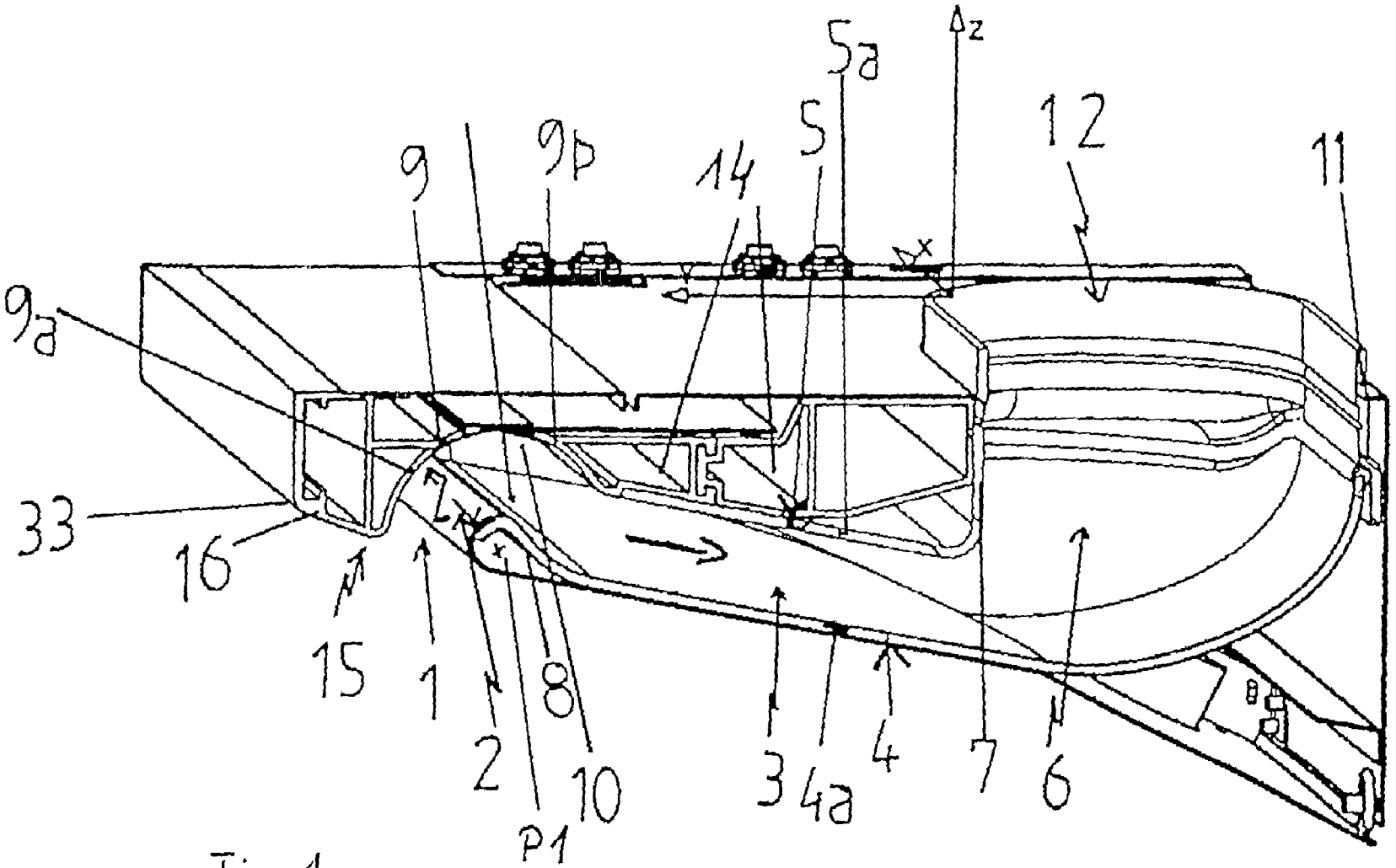

In FIG. 1, an embodiment of a separating device according to the invention in the form of an exhaust hood is illustrated. The exhaust hood has a longitudinal intake opening 1 that has a length L and, in a plan view onto the bottom plate 4, is rectangular. An intake chamber 2 adjoins the intake opening 1 through which an airflow enters the air conveying duct 3 arranged downstream. The air conveying duct is laterally delimited by the bottom plate 4, a top plate 5 positioned at a spacing from the bottom plate 4, and sidewalls, not illustrated in detail. The air conveying duct 3 opens into an exhaust chamber 6 whose bottom is also formed by the bottom plate 4. The exhaust chamber 6 is delimited at one side by the inner plate 7 and at the opposite side by a backplate 11 into which the bottom plate 4 passes in the flow direction. The backplate 11 is positioned at an angle of 80°-90° to the bottom plate 4. In the area of the transition, the bottom plate 4 is pivotably connected to the backplate 11 by means of conventional hinges. The swivel connection enables the bottom plate 4 to be folded for service and cleaning purposes, particularity also in order to clean the deposition surface 10. Instead of a hinged connection, the bottom plate 4 can also be connected in a detachable and removable way to the frame of the exhaust hood.

The backplate 11 is arranged upright and vertically and can be supported against the wall of a stove device. In particular the central section 4*a* of the bottom plate 4 and the central area 5*a* of the top plate 5 form an air conveying duct 3 through which the airflow passes in the direction of the exhaust chamber 6 (see arrow). The air conveying duct 3 generally is to be understood not only as this section but the entire stretch through which the airflow travels through the device according to the invention.

Through the intake opening 1 the airflow to be cleaned enters the intake chamber 2. The intake chamber 2 is delimited at the upper side by the forward area 9, the top plate 5 and at the lower side by the forward section 8 of the bottom plate 4. The forward area 9 of the top plate 5 in cross-section is of a semi-circular arc shape. The side of the forward section 8 of the bottom plate 4 that faces the intake chamber 2 is in cross-section approximately shaped like a three-quarter circular arc. The angular range of the forward area 9 and of the forward section 8 can also be provided with different angular ranges than those of the illustration which different angular ranges can be suitable for a particular application. Because of the circular arc-shaped configuration in cross-section of the forward area of the upper plate and the configuration of a circular arc shape in cross-section of the forward section of the bottom plate 4, there are no interfering corners and edges so that the airflow can be taken in at a high speed essentially without frictional losses.

In one configuration of the bottom plate 4 and/or of the top plate 5 of the device according to the invention, it can be produced entirely or partially as a continuous-cast part 16 by providing cavities for increasing the dimensional stability of the top plate 5 and/or of the tongue plate 15. Moreover, when configuring the upper plate 5 as a continuous-cast part 16, the device according to the invention is characterized by a minimal weight.

The term forward section 8 and forward area 9 are not to be understood as spatially limited to the front area of a device but relate only to the illustrated embodiment. The deflection of the airflow in the manner according to the invention can also be realized in a central, lateral or rear section of an air conveying duct 3.

The center P1 of the circular arc section of the bottom plate 4, as illustrated, can be concentric to the center of the circle of the forward area 9 of the upper plate 5. Also, it is possible that the center P1 of the forward section 8 of the bottom plate 4 and the center of the forward area 9 of the top plate 5 are staggered in the direction of the backplate 11 by 1.5 to 3.0 times the radius of the forward area 9 of the top plate 5. For a concentric position of the centers, an air conveying duct 3 results in the forward area whose free height h in the flow cross-section remains substantially the same while for a staggered arrangement of the centers an air conveying duct 3 results that is constricted in one direction.

These sides of the forward area 9 and of the forward section 8 are characterized by the lack of corners and edges, which is beneficial with regard to flow technological considerations, so that the taken-in airflow can flow with minimal friction through the intake chamber 2 without generating turbulences usually caused by corners and edges.

Since preferably the length of the intake opening 1 is greater than the length of the outlet opening 12, a trapezoidal flow movement of the airflow within the air conveying duct 3 can be observed in a plan view. In the illustrated embodiment, the length of the intake opening 1 is 2 times greater than the length of the outlet opening 12, and, in this way, a trapezoidal flow movement of the airflow within the air conveying duct 3 results in a plan view. The length L of the intake opening 1 can be 1.5 to 3.5 times the length of the outlet opening 12.

Because of the trapezoidal air movement in operation of the device according to the invention, the air masses are taken in such that in the effective area of suction outside of the device airflow rolls are produced that move helically in the direction toward the intake opening 1. The axis of rotation of the air rolls can be arranged perpendicularly to the longitudinal center axis of the elongate intake opening L. The helical movements of the airflows that can be observed at both sides of the bottom plate 4 show that even air masses that are laterally displaced and far from the device according to the invention are sucked in. These air rolls support and entrain neighboring air masses so that the length of the intake opening 1 of the device according to the invention must not match the length value or width value of the stove devices but can equally well be smaller. As a result of the airflow entering at a high speed through the intake opening 1 by way of the air conveying duct 3 the outlet chamber 6, the airflow is deflected by the forward area 9 of the top plate 5 so that the suspended particles of the airflow are able to deposit on the side of the forward area 9 of the top plate 5 facing the forward section 8. Because of this effect, the device according to the invention is constructively of a comparatively small size while still providing a large range of action.

In one embodiment, the forward area 9 of the top plate 5 is divided in two parts and two quarter-circle forward partial areas 9*a*, 9*b* are formed. The tongue plate 15 together with the first quarter-circle forward partial area 9*a* can be moved away from the backplate 11. The magnitude of displacement of the tongue plate 15 controls the degree of removal of the air masses. Suspended particles that occur upon sudden boiling of liquids are effectively removed in the direction of the intake opening 1 by the airflow that is caused by enlarging the intake opening 1. Moreover, air masses that are laterally displaced far away from the exhaust hood that is provided with the device according to the invention can be sucked in by pulling out the tongue plate.

In one configuration of the top plate 5 of the device according to the invention, it can be entirely or partially designed as a continuous-cast part providing cavities for increasing the dimensional stability of the top plate and/or of the tongue plate. Moreover, when configuring the top plate 5 in the form of a continuous-cast part, the device according to the invention is characterized by a minimal weight.

Figure 3:
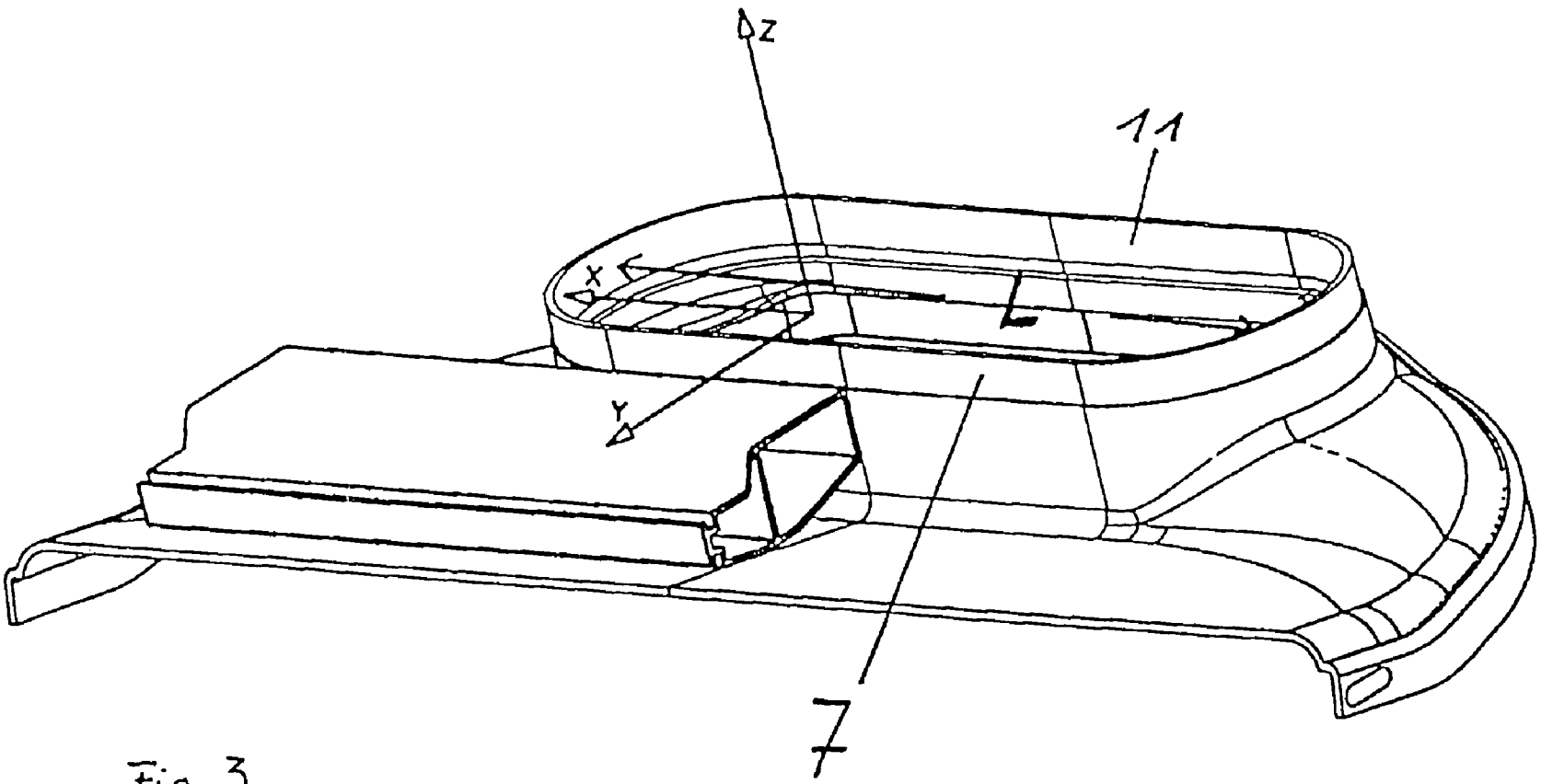
Figure 4:
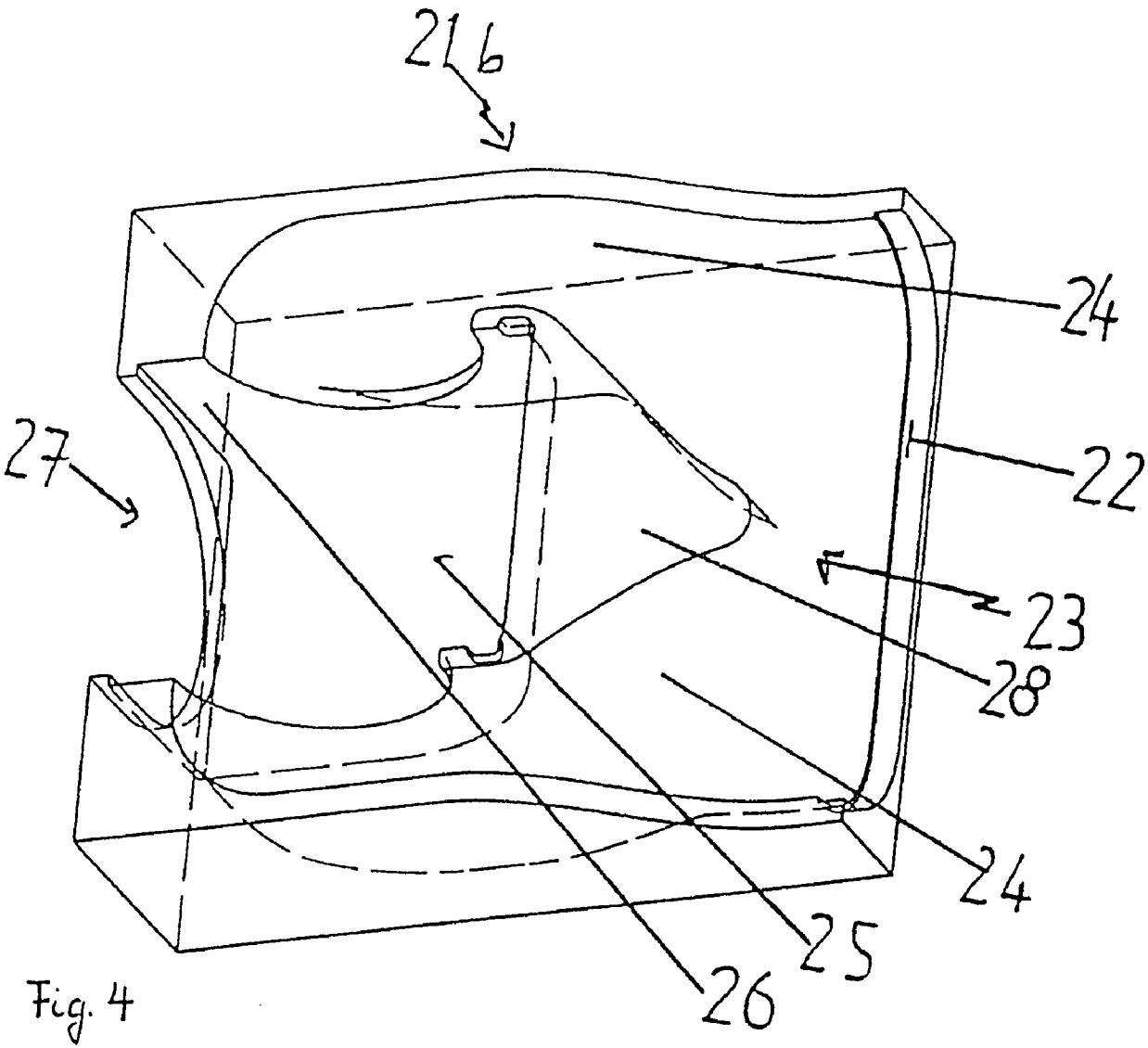
Figure 5:
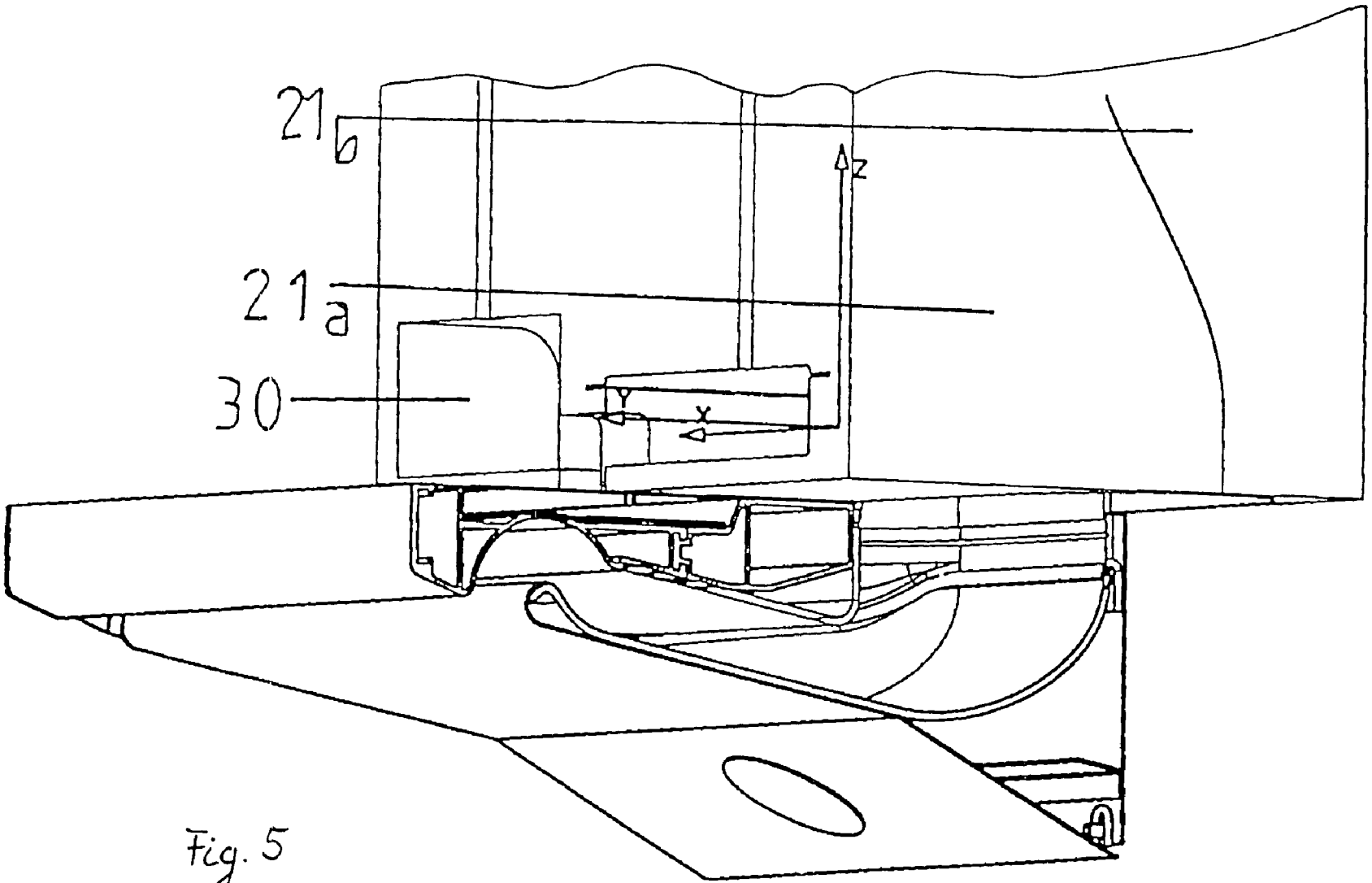
Figure 6:
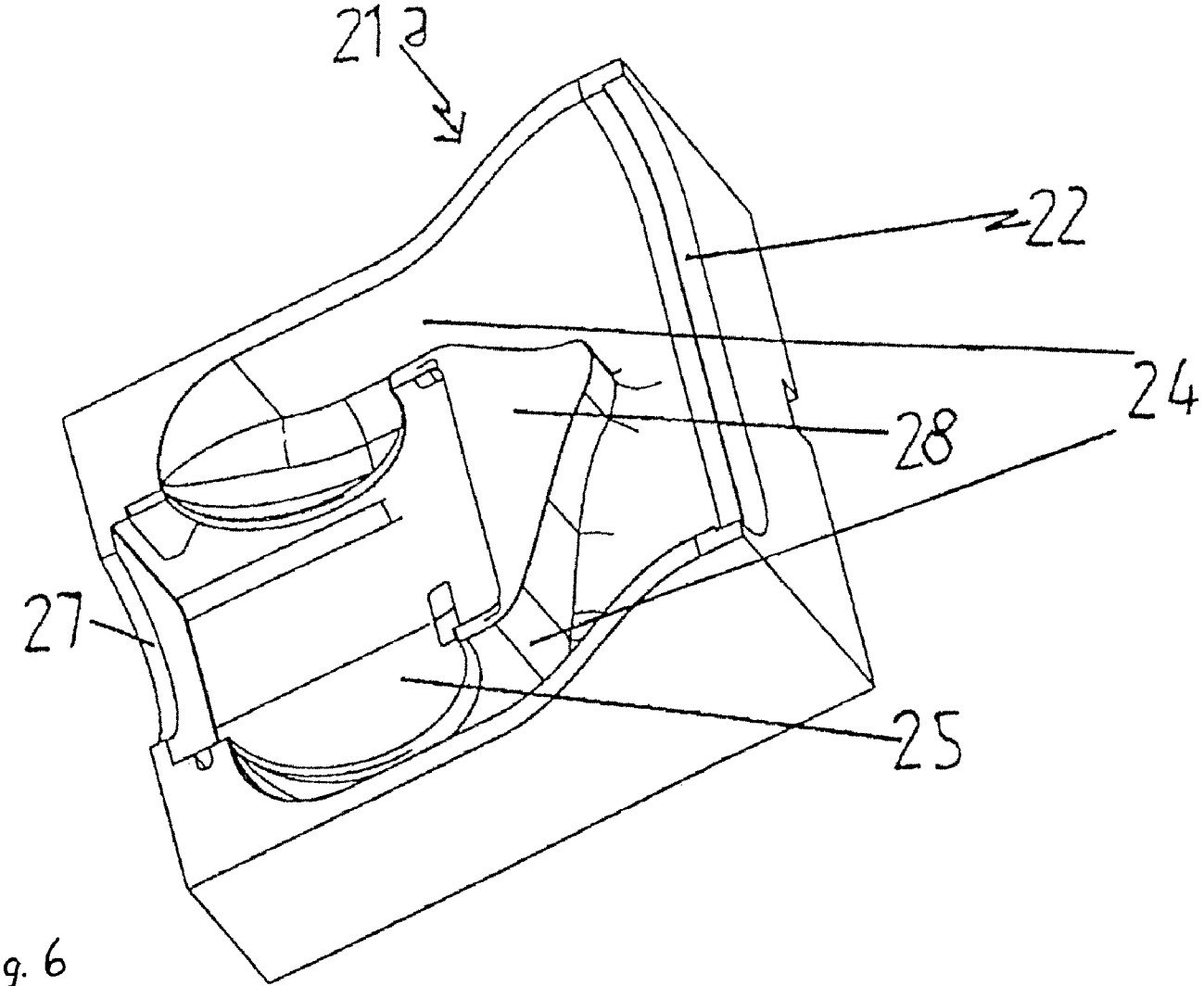
Figure 7:
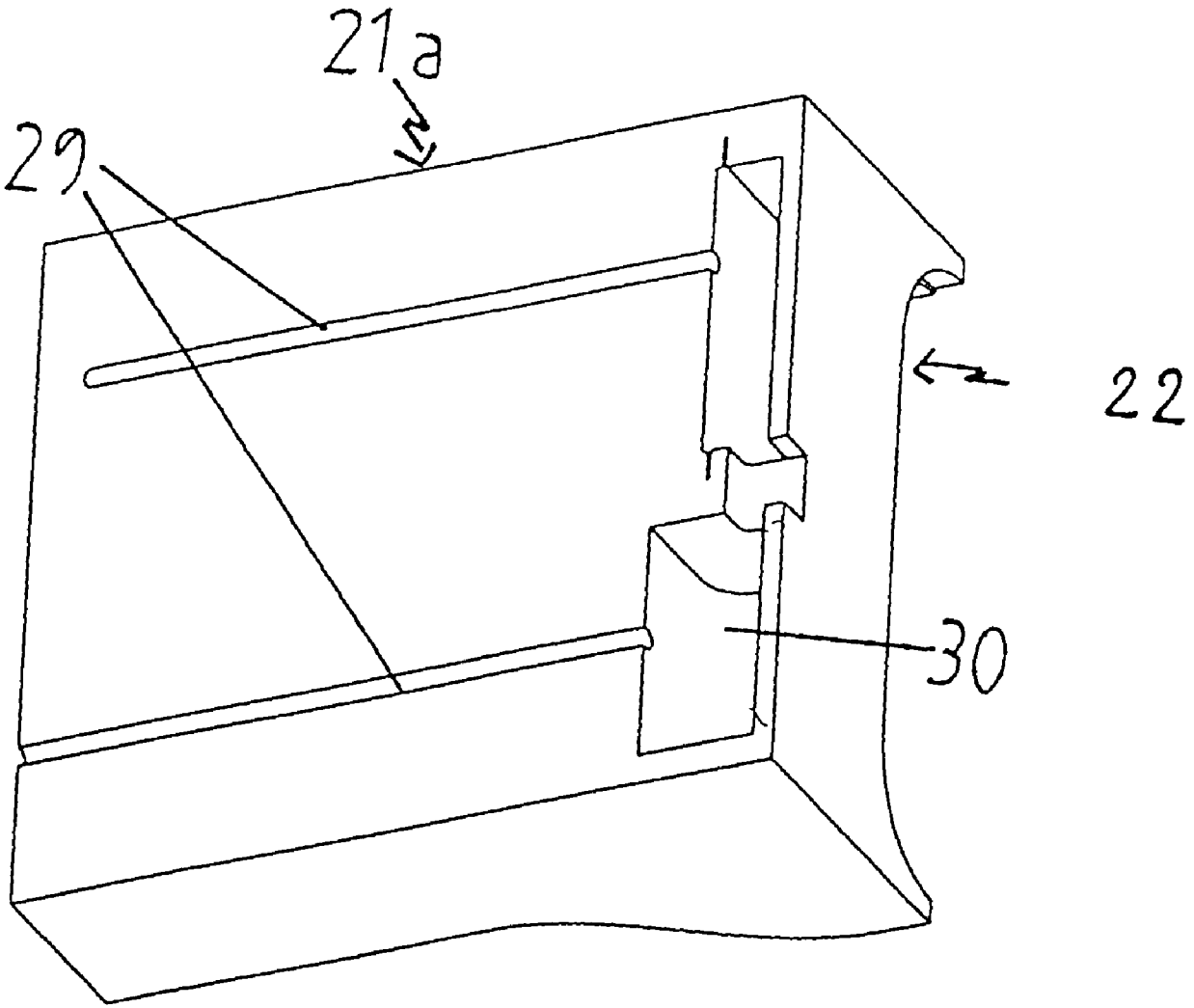
Figure 8:
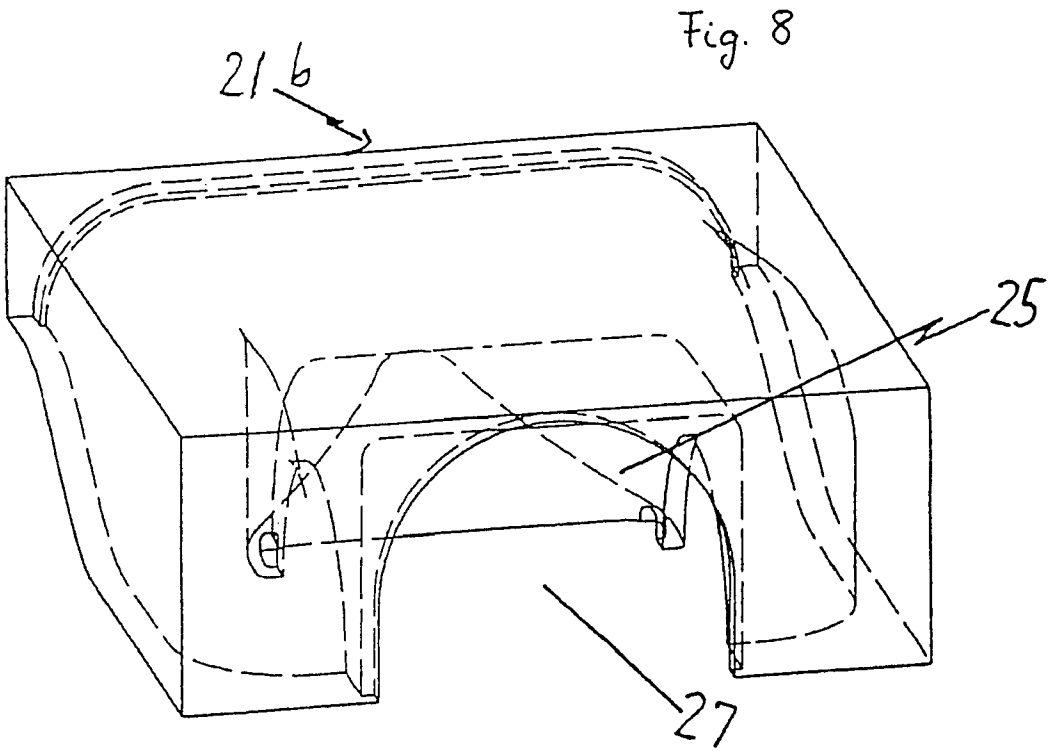

The airflow is conveyed through the air conveying duct 3 into the exhaust chamber 6 essentially without friction and at a low noise level. The exhaust chamber 6 is laterally forwardly delimited by the inner plate 7 and to the rear by the backplate 11. The inner plate 7 and the backplate 11 have a transition into one another and form the exhaust chamber 6 that is oval in a plan view and provided with an oval outlet opening 12 and a length L. A component that delimits the exhaust chamber 6, into which the backplate 11 and the inner plate 7 as well as the other sidewalls are integrated to form a single component, is illustrated in FIG. 3. The outlet opening 12 can also be round or circular.

Because of the smooth configuration of the intake chamber 2, of the air conveying duct 3, of the sides of the top plate 5 facing the exhaust chamber 6, the bottom plate 4, the inner plate 7, and the backplate 11, there are no dead spaces which in comparison to the prior art can cause turbulence. Also, by means of the smooth configuration of the sides by which also the aforementioned intake chamber 2, the air conveying duct 3, the exhaust chamber 6 are delimited, the inventive device can be operated at an extremely low noise level.

It has been found that the device according to the invention can remove, when used for example, as an exhaust hood, under favorable conditions approximately up to 100% of all suspended particles from the airflow. The device can be cleaned easily and without leaving residues by removing the deposits in the area of the forward area 9 of the top plate 5 without any risk of injury by edges or corners.

Also, it was found that the airflow is greatly accelerated by the suction effect in the form of the so-called rim suction that is generated in the forward area 9 of the device according to the invention in the area of the intake opening 1. The edges that form the intake opening 1 of the intake chamber 2 are of such a smooth configuration that the flow in these areas will not stall and that, therefore, air can be sucked in by means of the device according to the invention in front of, above, and from the rear area and lateral areas of the device according to the invention. This success is based inter alia on the combination of the trapezoidal flow from the intake chamber 2 via the air conveying duct 3 and the exhaust chamber 6 to the outlet opening 12.

In addition, to the right and to the left at the bottom side of the bottom plate turning air swirls, referred to as air rolls, extending from the front to the rear will be produced that ensure that suspended particles that rise from the stove devices within a wider area at a distance can also be laterally entrained and cannot escape but instead will be collected and sucked in by the device according to the invention.

The tongue plate 15, the top plate 5, and other components are manufactured as continuous-cast parts 16 that provide at the same time cavities 14 for increasing their dimensional stability; furthermore, they are characterized by a minimal weight.

Directly after the sucked-in airflow has entered the device according to the invention, the airflow is deflected twice. In connection with the high air speed, approximately 95% of the suspended particles suspended in the airflow, such as grease particles, oil particles, and water vapor, moisture etc., are thrown centrifugally out of the air and in the area of the deflection, here the forward area of the top plate, are deposited in a targeted and certain way.

Figure 9:
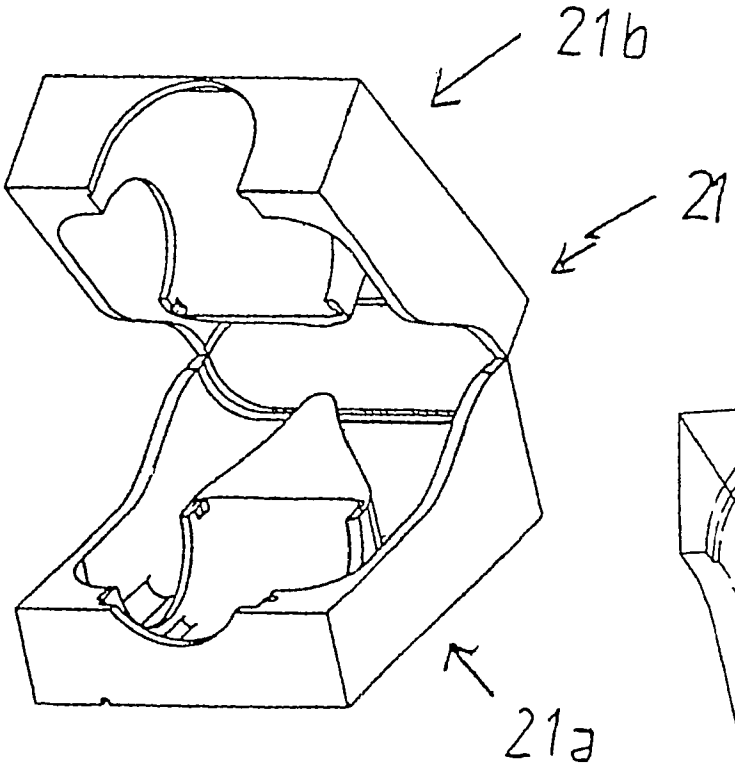

The housing 21 according to the invention is comprised of two housing parts, a forward one 21*a* and a rear one 21*b*, wherein the housing 21, as illustrated in FIG. 9, is divided in a direction along the direction of airflow. Other divisions are also possible. The detachable coupling of the housing 21 to the exhaust chamber 6 provides simple and easy access to all components of the device according to the invention.

A housing 21 adjoins the outlet opening 12 that is arranged at the topside of the device of the present invention; the housing is preferably comprised of plastic-like material such as, for example, polyurethane foam. For manufacturing the housing 21 according to the invention of plastic material, polymers can be employed such as polystyrene, polycarbonate, polyolefin, polyurethane, polyamide etc. The foam structure can be created as a result of chemical reactions, for example, in the case of polyurethane by addition of blowing agents which at certain temperatures during processing decompose while forming a gas or by addition of volatile solvents during polymerization. Foaming can be realized upon exiting from the extrusion mold or in open molds or during injection molding. The housing 21 according to the invention dampens to a high degree the noises that are generated by the fan.

The mounting position of the housing 21, its components, and details of the inner and outer surface configuration are illustrated in FIGS. 4 through 9.

Figure 2:
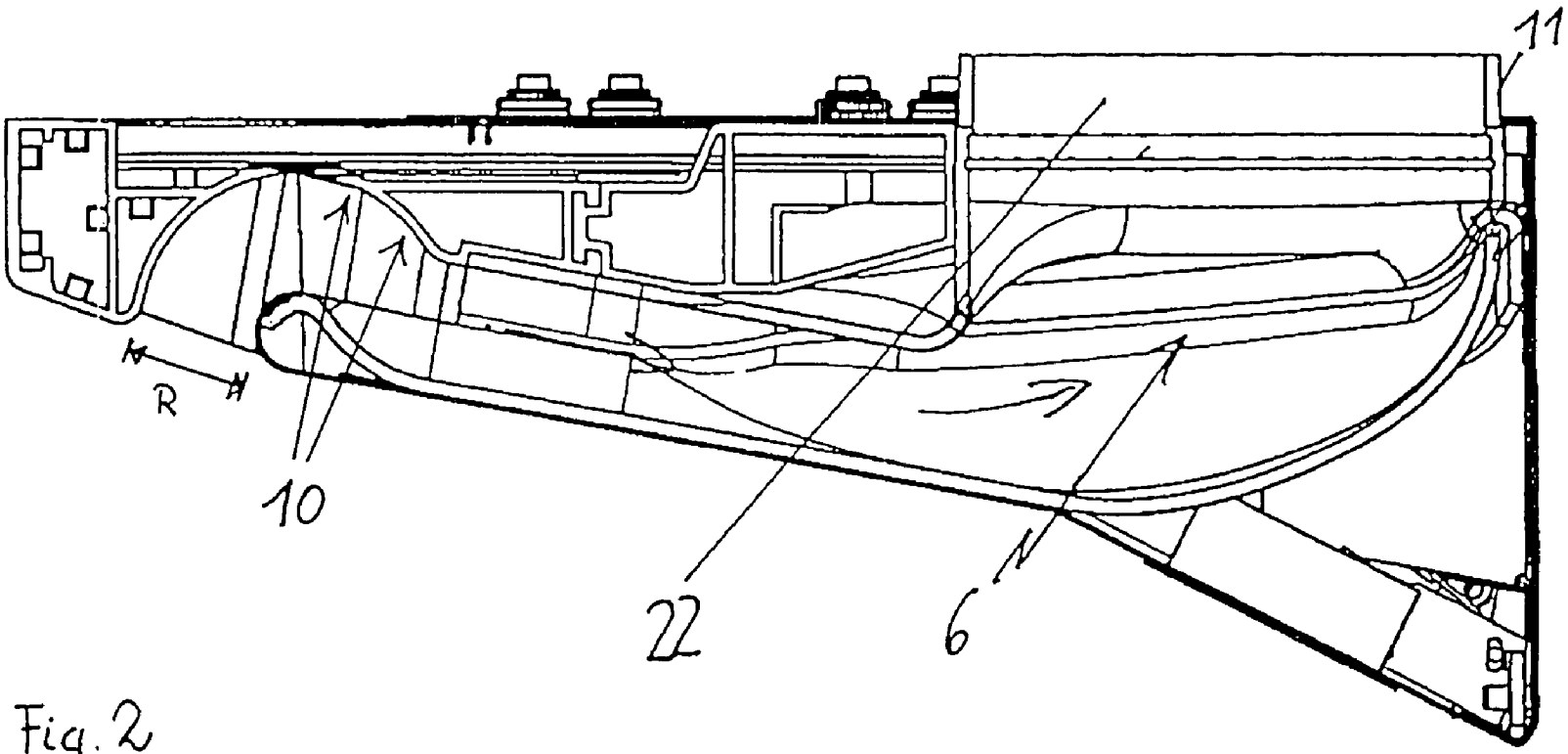

The housing 21 has an intake opening 22 through which the airflow exiting the exit opening 12 is conveyed via the intake opening 22 illustrated also in FIG. 2 into the intake chamber 23 of the housing 21 according to the invention and, finally, by means of the fan that is arranged centrally in the fan chamber 25 in the housing 21, is conveyed to the exterior through the exhaust chamber 26 and the exhaust opening 27. The sides of the housing 21 that are facing the intake chamber 23, the intake channels 24, and the exhaust chamber 26 are also smooth and of a flat configuration. The surfaces that are smooth and designed in a way beneficial in regard to flow considerations prevent the generation of unwanted noises, and there are hardly any output losses because there are no turbulences of the airflow and no so-called dead spaces within the air conveying duct 3. The speed of the airflow that is taken in by the fan can be 3.0 to 30 M/sec, preferably 5.0 to 20.00 m/sec wherein the fan that is arranged in the housing 21 takes in the airflow at a volume between 200 and 1,100 $m^3$/hr. These values are valid in an exemplary fashion for exhaust hoods that are designed for non-commercial use. For other applications different values may result.

The fan power is selectable by means of an operating field in different stages wherein the different fan stages can have hardly any effect on the flow path of the airflow along the air conveying duct 3. Accordingly, there is hardly any effect on the efficiency of the removal effect by the deflection of the airflow. The airflow that is taken in through the intake opening 1, after passing the positive guiding means, contains hardly any suspended particles or finest particles. In the intake opening 1 of the device according to the invention, the speed of the taken-in airflow can have a value in the range of approximately 6.0 to 11.0 m/sec wherein in the illustrated embodiment the fan arranged within the housing 21 in one of several fan stages sucks in the airflow only at 610 $m^3$/hr.

The term smooth surface in the context of the invention is to be understood also to mean that the sides have no edges and corners and that the formation of so-called dead spaces is prevented.

Also, the risk of injury when cleaning the housing 21 is reduced because edges and corners are not present and because smooth surfaces are provided on the sides of the housing 21 facing the intake chamber 23, intake channels 24, and exhaust chamber 26. Because of the high efficiency of removal by means of the device according to the invention, and optionally the deflection element 40 according to the invention, deposits regularly no longer occur in the chambers and ducts of the housing 21 according to the invention. Moreover, the housing 21 according to the invention soundproofs and dampens not only the noises that occur during operation of the fan but also possible vibrations which in conventional devices can be caused by deposits within the fan that have not been filtered out.

The housing 21 according to the invention has recesses 29 for external supply lines such as channels for cables and control devices for the fan. The intake chamber 23 has a transition into two intake channels 24 in that the airflow is divided by a distribution member 28 that is triangular in plan view.

The two-part housing 21 enables minimal manufacturing and operating costs by means of simple coupling as well as flow-beneficial guiding of the airflow to the fan. The present invention does not mandatorily require air guiding through the above described housing for ensuring the function of removal of the suspended particles. In order to save costs, the housing 21 can also be eliminated and the fan can be arranged, as is conventional, at a location of the air conveying duct between the intake and exhaust openings.

The airflow on its path through the device according to the invention can also flow through a deflection element 40. The deflection element 40 according to the invention serves for fine separation of finest particles from the airflow and has thus a filter function. It can be provided at a location in the air conveying duct 3, particularly however between the exhaust chamber 6 and the intake chamber 23 in the area of the intake opening 22 of the housing 21. This position is advantageous because there here already a great portion of the suspended particles has been removed from the airflow, but by means of the deflection element 40 residual suspended particles, dust etc. can still be removed from the airflow before the airflow can reach the fan.

Figure 10:
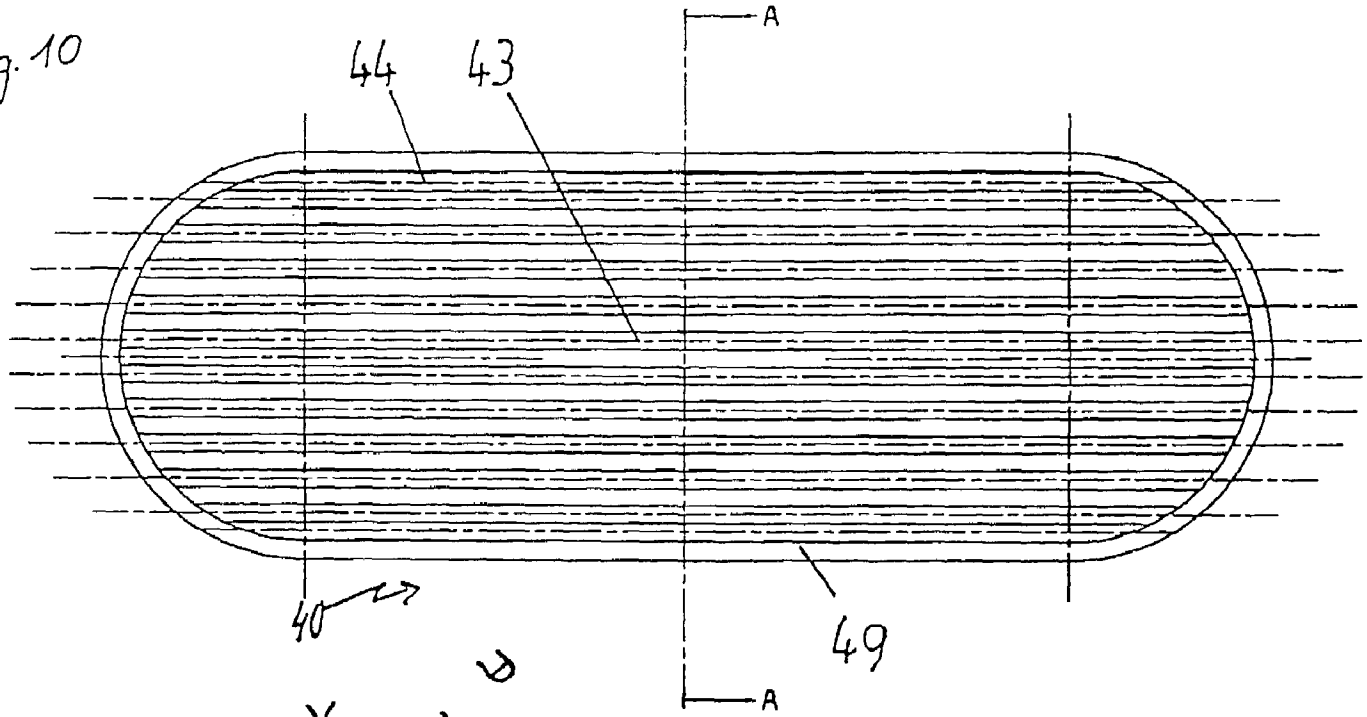
Figure 11:
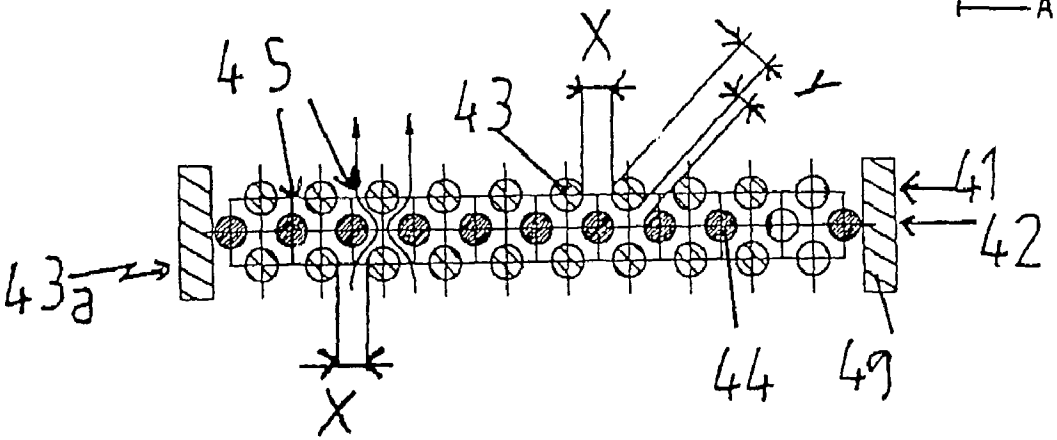
Figure 13:
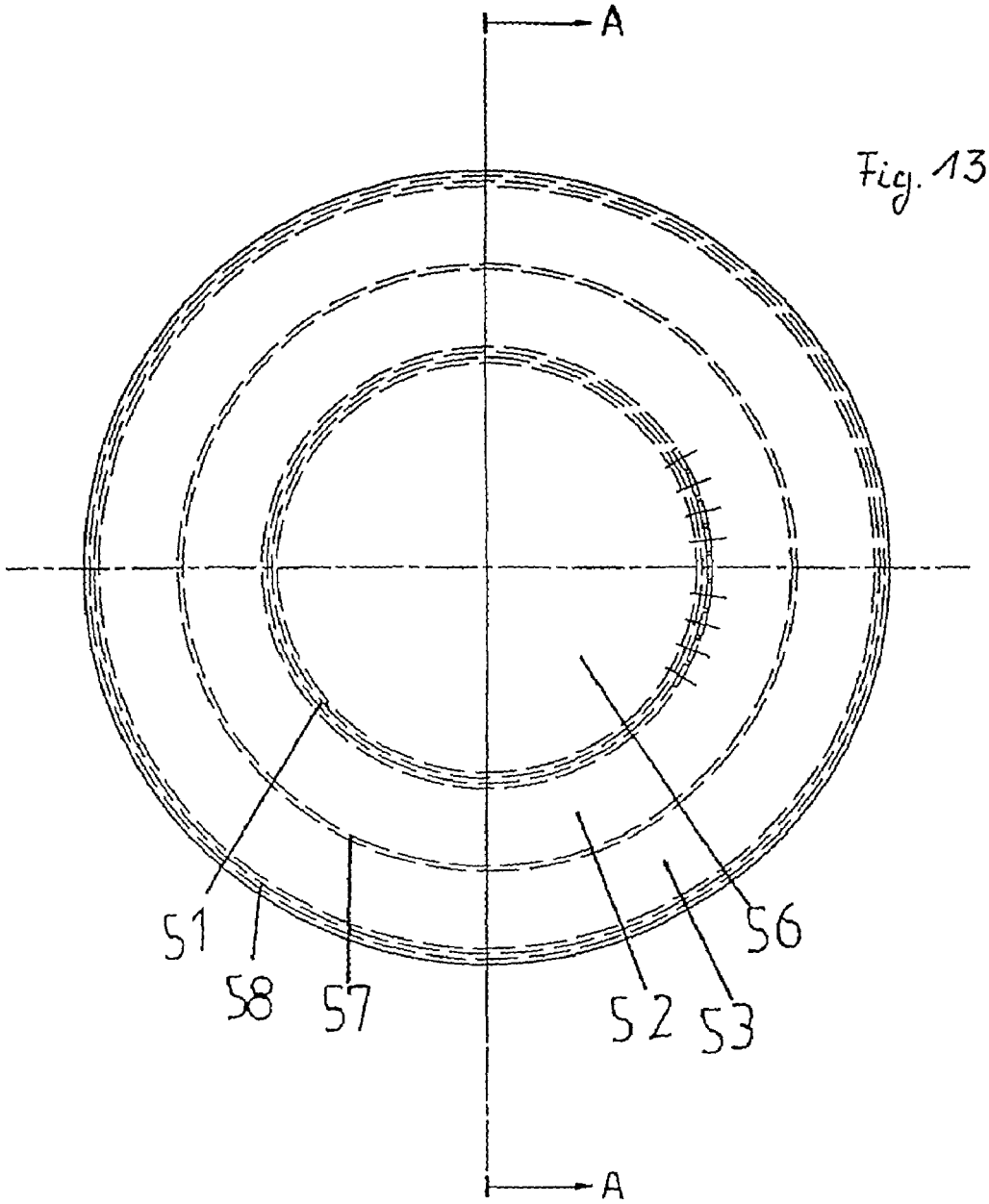
Figure 12:
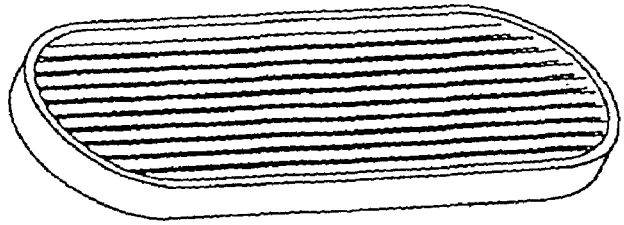
Figure 14:
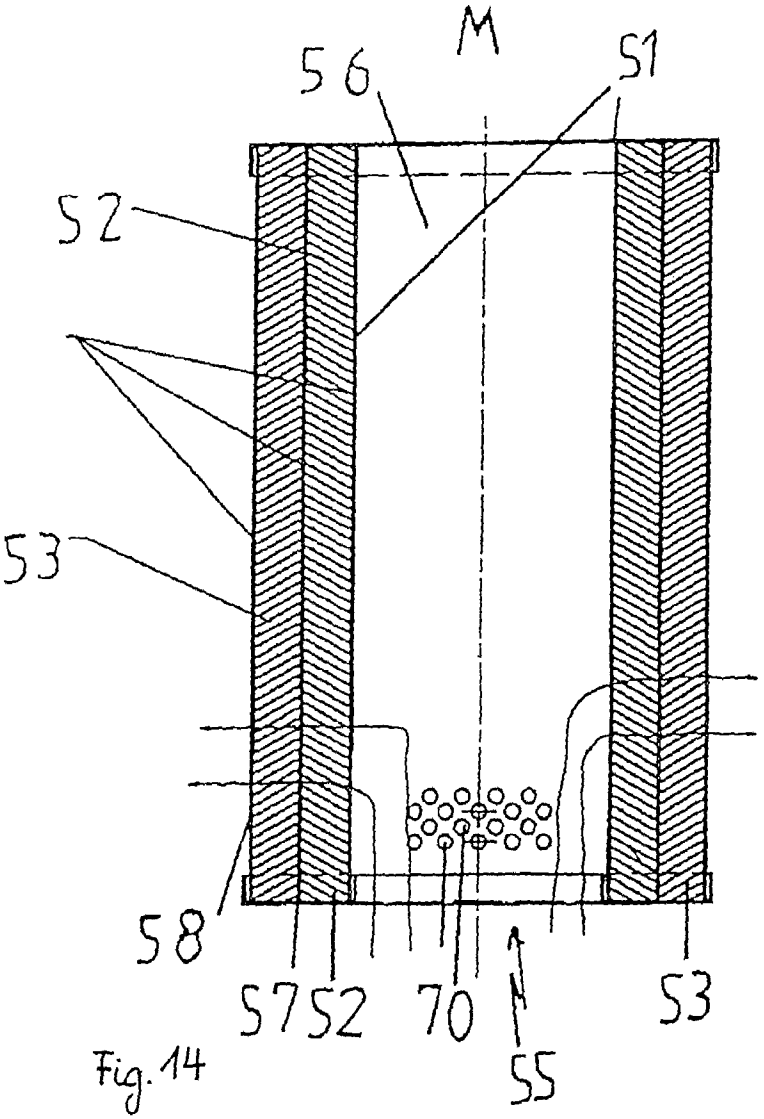
Figure 15:
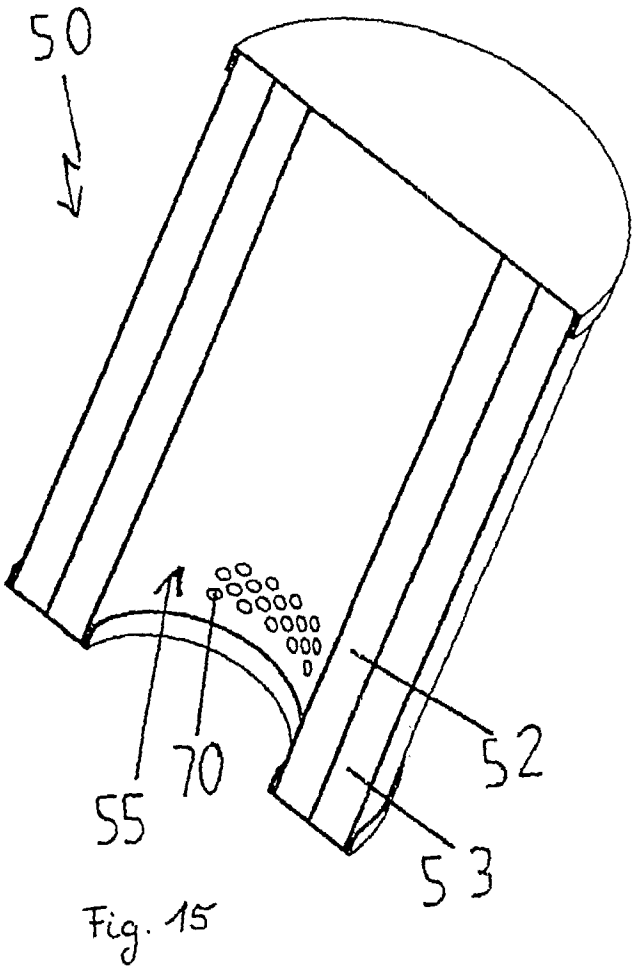

The deflection element 40 according to the invention is disclosed in more detail in FIGS. 10 and 11. It is comprised of a module 43*a* of two layers 41, 42 with a circumferential wall 49. The layers 41, 42 are comprised of several adjacently arranged, parallel extending, spaced apart rods 43, 44. All rods 43, 44 have identical outer diameter D. The rods 43 of the layer 41 have the same spacing X from one another. The rods 44 of the other layer 42 are also equally spaced from one another at the spacing X. All spacings X of the rods 43, 44 of the deflection element 40 according to the invention are constant. The spacings X of the rods 43, 44 relative to one another are smaller than the outer diameter D of the rods 43, 44 of the deflection element according to the invention.

The rods 43, 44 of each layer 41, 42 form so-called gaps 45 because of their spacing relative to one another. The two layers 41, 42 of the module 43*a* are aligned with their rods 43, 44 relative to one another such that the rods 44 of the second layer 42 cover at least approximately gaps 45 of the immediately adjacently arranged layer 41 when viewed in the flow direction of the airflow. It is also possible to arrange several modules 43*a* on top one another with parallel alignment of the rods 43, 44 relative to one another; however, this is not illustrated in detail in the drawings.

In the stacked arrangement of the two layers 41, 42 so as to cover the gaps 45, respectively, that rod 44 of the second layer 42 that is positioned on the gap 45 of two rods 43 of the first layer 41 is positioned at a certain spacing Y relative to these two rods 43 of the layer 41. The spacing Y in the context of the invention is referred to as diagonal spacing or diagonal spacing Y. The spacings Y of the rods 43, 44 of two neighboring layers 41, 42 of the deflection element according to the invention are constant and identical in the illustrated embodiment but can also be different, in particular, when several modules are stacked on top one another.

The spacings Y of the deflection element according to the invention are smaller than the outer diameter D of the rods of the deflection element according to the invention. The spacings X are identical to the spacings Y.

At the effective surface of the rods 43, 44 of the module 43*a* of the deflection element 40 according to the invention that faces the incoming airflow finest particles contained in the airflow will deposit. With this arrangement of the deflection element according to the invention in the exhaust chamber 6, the airflow is deflected again, but at reduced air resistance, and produces at most only minimal noise. As a result of the easy pivoting action of the bottom plate 4 in a direction away from the exhaust chamber 6, the exhaust chamber 6 is accessible easily from the exterior so that the deflection element 40, for example, can be removed from the exhaust chamber 6 without problems, cleaned, and reinserted. The rods 43, 44 are of a hollow cylindrical configuration or solid, for example, of metal and/or plastic.

Instead of the proposed configuration of the deflection element 40, it can also be provided in a different shape, for example, in the form of a single layer or multilayer wiremesh.

Moreover, a tubular filter part 50, illustrated in FIGS. 12-15 in more detail, can be coupled within the air conveying duct 3, in the illustrated embodiment to the exhaust opening 27 of the housing 21. The tubular filter part is cylindrical and provided with an inner hollow-cylindrical distribution chamber 56 wherein the distribution chamber 56 is laterally limited by a first air-permeable wall 51 that also has a hollow cylindrical shape. Air guiding and air distribution can be effected in a beneficial way by special air guiding elements, for example, a distribution cone arranged in the distribution chamber 56 and oriented to oppose the airflow.

On the outer side of the first air permeable wall 51 a layer 52 of anthracite coal is formed thereon as a filter medium. This layer of the filter medium is gas permeable. As a filter medium preferably lean coal types are used, from shiny deep-black appearance to shell-shaped scrap. The anthracite coal can be comprised of less than 1% water and from 7 to 12% volatile components. A second air-permeable wall 57 is located at the outer side of the layer 52 of anthracite coal.

On the outer side of the second air-permeable wall 57 a further facultative and also gas-permeable layer 53 of active carbon as a filter medium is formed and is delimited externally by a third air-permeable wall 58. The active carbon layer used as a filter medium can be comprised of carbon structures of smallest graphite crystals and amorphous carbon with porous structure and an inner surface between 500 and 1,500 $m^2/g$. For example, the employed components can be active carbon powder, granular active carbon or cylindrically shaped active carbon. This double layer of filter media provides an improved filter efficiency.

The tubular filter part 50 is exposed to an airflow in the radial direction wherein the airflow flows in from the bottom through a lower opening 55 into a distribution chamber 56. From here, the airflow flows via the penetrations 70 of the first air-permeable wall 51 radially to the layer 52 of anthracite coal for residual moisture removal from the air flow. Subsequently, the airflow passes through penetrations 70 in the second air-permeable wall 57 into the layer 53 of active carbon for removal of odor molecules and exits laterally through passages of the third air-permeable wall 58. By arranging the tubular filter part 50 at the end of the air conveying duct 3, the air flow is cleaned in the best possible way from almost all suspended particles, moisture etc. so that the tubular filter part 50 takes up essentially only the odor molecules. This and the high filter capacity of the proposed tubular filter part 50 have a positive effect on the service life of the tubular filter part 50.

The tubular filter part 50 according to the invention serves in particular for removing odor molecules from the air flow so that, after a substantial complete removal of the suspended particles and odor molecules, it can be returned to the room that contains the stove device. The device according to the invention in combination with the deflection element 40, the housing 21 according to the invention, and optionally the tubular filter part 50 according to the invention enables, for example, in the form of an exhaust hood, the removal of suspended particles in a closed air circulation.

The invention has been explained above with the aid of embodiments, and in the following the functional principle upon which the invention is based will be explained by means of schematics.

Figure 16:
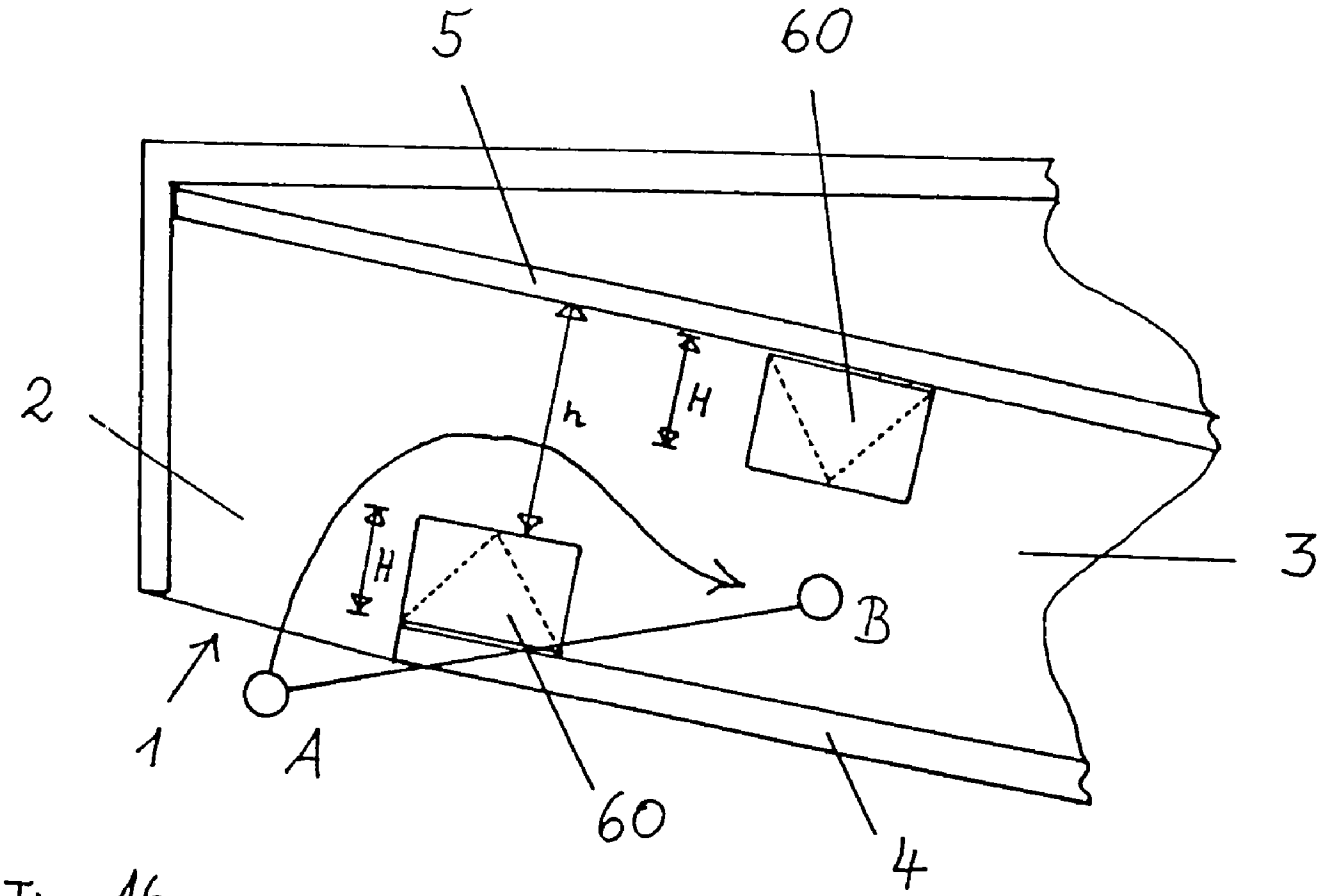

In FIG. 16, an air conveying duct 3 is illustrated into which through the intake opening 1 an airflow flows into the intake chamber 2 that is correlated with the air conveying duct 3. In principle, the airflow through the air conveying duct 3 is oriented starting at the intake point A in the direction of a point B that is arranged downstream within the air conveying duct 3. In the air conveying duct 3 a general conveying direction A-B results. The positive guiding means 60 are positioned in the air conveying duct 3 and relative to one another such that the airflow along its general conveying direction A-B is subjected to at least a twofold sequentially occurring curve-shaped deflection in different directions. Such a deflection results when the positive guiding means 60 are arranged opposite one another and, viewed in the conveying direction, are positioned at a spacing to one another within the air conveying duct 3. For obtaining the action according to the invention, i.e., the forced removal of suspended particles moved within the airflow, the type of positive guiding means is not decisive. For example, the positive guiding means 60, illustrated in FIG. 16, are illustrated in solid lines as rectangular bars; however, they can also be bars of a triangular cross-section as illustrated in dashed lines. Also, other cross-sections are possible as long as the double deflection oriented in the general conveying direction A-B is realized. The forward section 8 described in the afore described embodiment in more detail represents with regard to the action principle nothing more than the positive guiding means 60 arranged in FIG. 16 on the bottom plate 4. Also, the deposition surface 10 disclosed in the afore described embodiment in more detail is with regard to its action principle a positive guiding means 60 as illustrated in FIG. 16 in the upper area of the air conveying duct 3 at the underside of the top plate 5. The path that the airflow must take because of the positive guiding means arranged in the air conveying duct 3 is schematically illustrated with regard to its course by means of the curved arrow starting at the point A.

Figure 17:
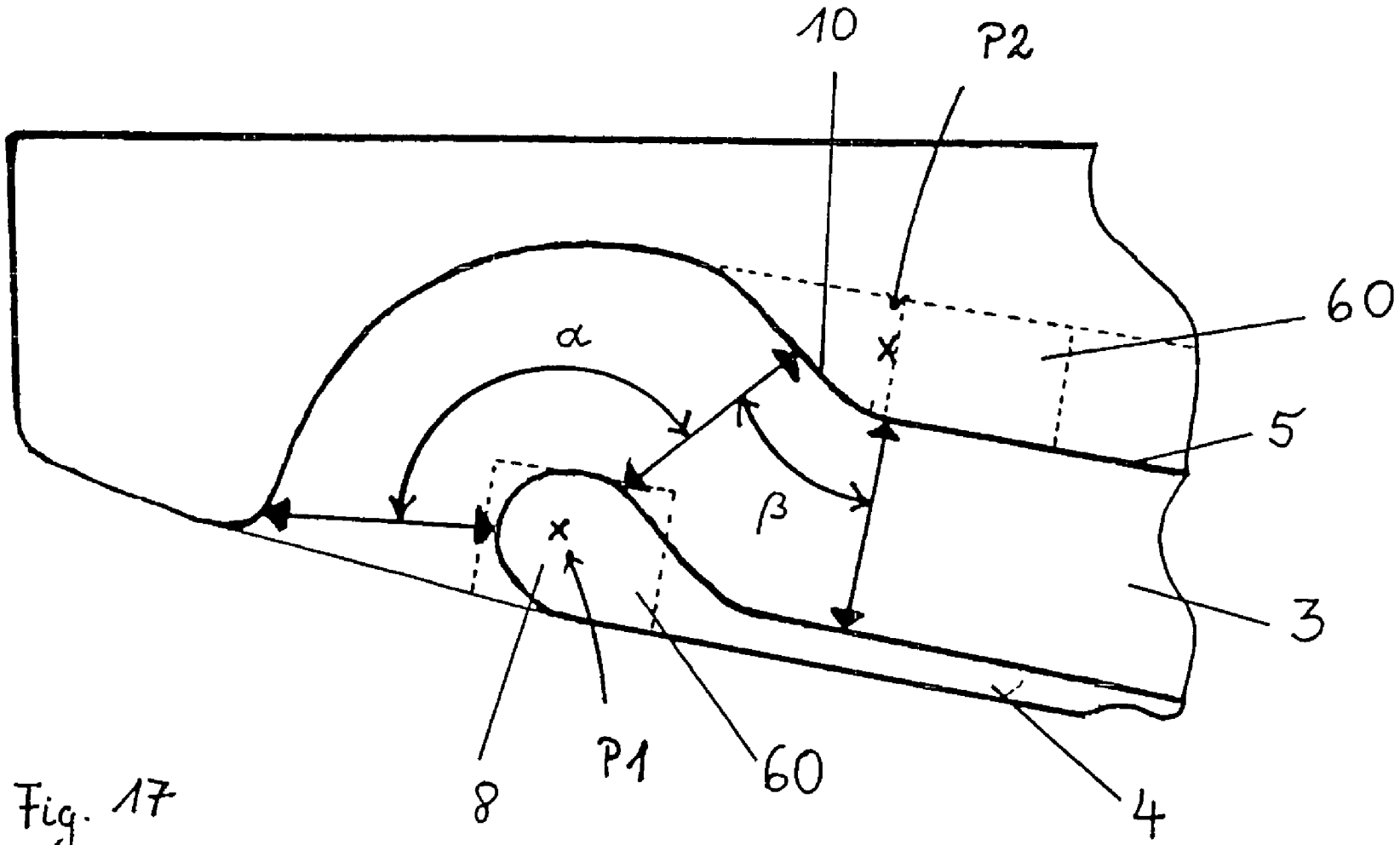
FIG. 17 illustrates bending radii that guide the air flow.

The positive guiding means 60 project by the height H into the air conveying duct 3. In the area of the positive guiding means 60, the free height of the flow cross-section of the air conveying duct 3 is thus reduced to the value h. Since the value H is smaller than the value h, the airflow is guided in a particularly tight radius about the positive guiding means 60. Because of the different travel distances that the airflow must travel at different levels of the flow cross-section along the respective radius, significant speed differences result in the airflow.

in FIG. 17, the bending radii by which the airflow is guided in the area of the positive guiding means 60 are explained in more detail. In dashed lines, the positive guiding means 60 are illustrated. In order to fulfill the requirement of a design of the air conveying duct 3 to be as beneficial to flow and as loss-reduced as possible, the air conveying duct 3 is designed by means of arc-shaped deflection plates such that the airflow can flow with a flow that is as laminar as possible through the area of the double deflection. At the location of the positive guiding means 60 arranged on the bottom plate 4, the forward section 8 explained in detail in the above embodiment is provided also whose circular arc-shape curved surface is guided about a transverse axis arranged on the point P1. In this connection, the deflection of the airflow guided within the air conveying duct 3 corresponds to a deflection angle $\alpha$ that is significantly greater than 90° in the illustrated embodiment. A second deflection of the airflow about an angle $\beta$ that is smaller than 90° in this embodiment adjoins the first deflection. The circular arc of the inner surfaces of the air guiding duct 3 is guided in the area of the second deflection about a transverse axis that is positioned spatially approximately at the position P2.

As can be seen particularly well in FIG. 17, the rotational direction of the angle $\beta$, differs from that of the angle $\alpha$. The angles illustrated in the embodiment are to be understood only as exemplary angles; a different magnitude and division of the angles $\alpha$, $\beta$ is possible.

Figure 18:
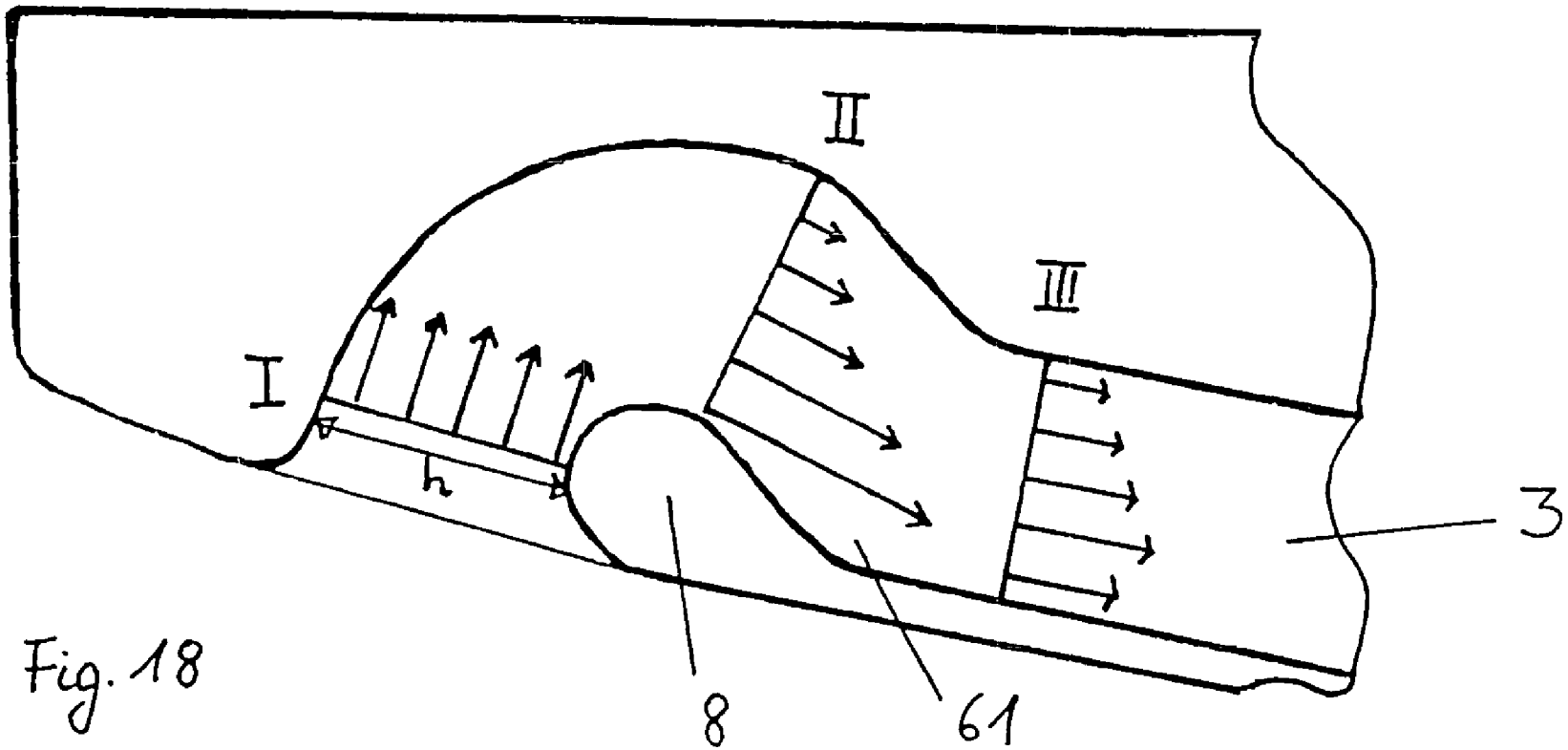
FIG. 18 illustrates different air velocities of the air flow in the air conveying duct.

In FIG. 18, the different flow velocities of the airflow in the air conveying duct 3 are illustrated, and particularly the different speed distribution as a function of the position of the measuring location in the area of the deflections, respectively. While the flow velocity across the free height h of the air conveying duct 3 in the area of the position I is still approximately identical, the airflow in the area of the position II across the free height of the flow cross-section moves at different speeds. While the proportion of the airflow that moves along the inner surface of the first deflection must travel only a short distance and therefore experiences an additional acceleration, those components of the airflow that are moving in the outer area of the airflow within the area of the first deflection must travel a significantly greater distance. In these zones, the air speed therefore will slow. The speed vectors illustrated in FIG. 18 are to be understood only in an exemplary fashion. Depending on the physical configuration of the air conveying duct 3 and the ingredients of the airflow and intermixing of the ingredients they can be different and can vary. The position III shows the speed distribution after the airflow has passed the second deflection. Because the portions of the airflow that have moved in the area of the first deflection in the outer curved area are located in the area of the second deflection at the inner curve, these airflow portions must travel a shorter path while the portions of the airflow that moved along the inner curve previously are now moving in the outer area. As a result of these converted distance ratios, inverse acceleration and deceleration effects result. Because in the lee of the forward section 8 a small dead space 61 is formed in which turbulences can be generated, the portion of the airflow within the outer curve is decelerated in the area of the second deflection more strongly than the more centrally arranged portions of the airflow.

Figure 19:
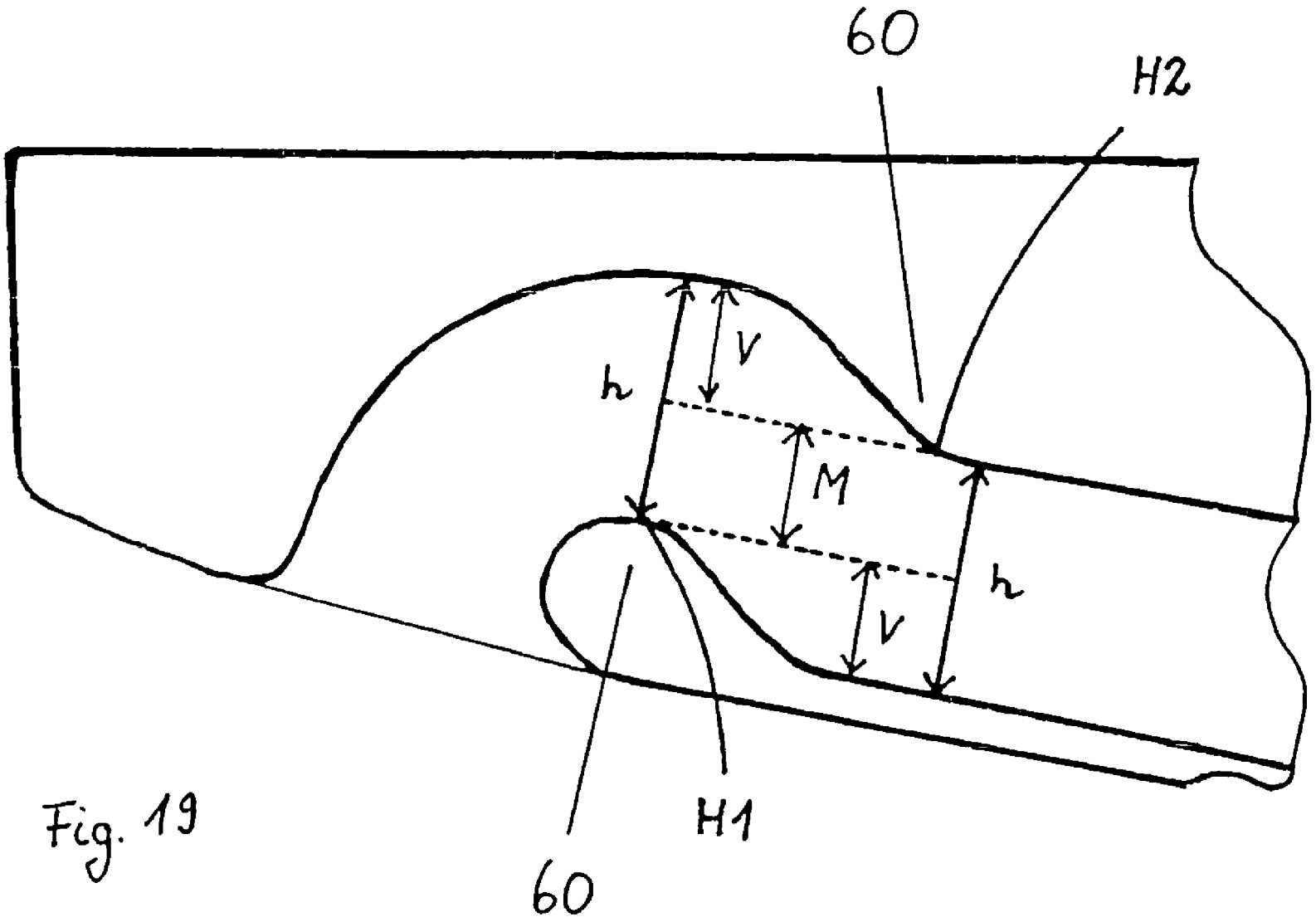
FIG. 19 illustrates the position of the respective apexes of the positive guiding means.

A kind of jet effect can be obtained when the air conveying duct 3 is configured such that, viewed in the flow direction, between the apex H1, illustrated in FIG. 19, of the first positive guiding means 60 and the apex H2 of the second positive guiding means 60 a vertical displacement by the value V with regard to the free height h of the flow cross-section of the air conveying duct 3 results. For such a vertical displacement, a central flow zone M can be formed in which the airflow can flow at high speed and minimal power loss through the air conveying duct 3.

Figure 20:
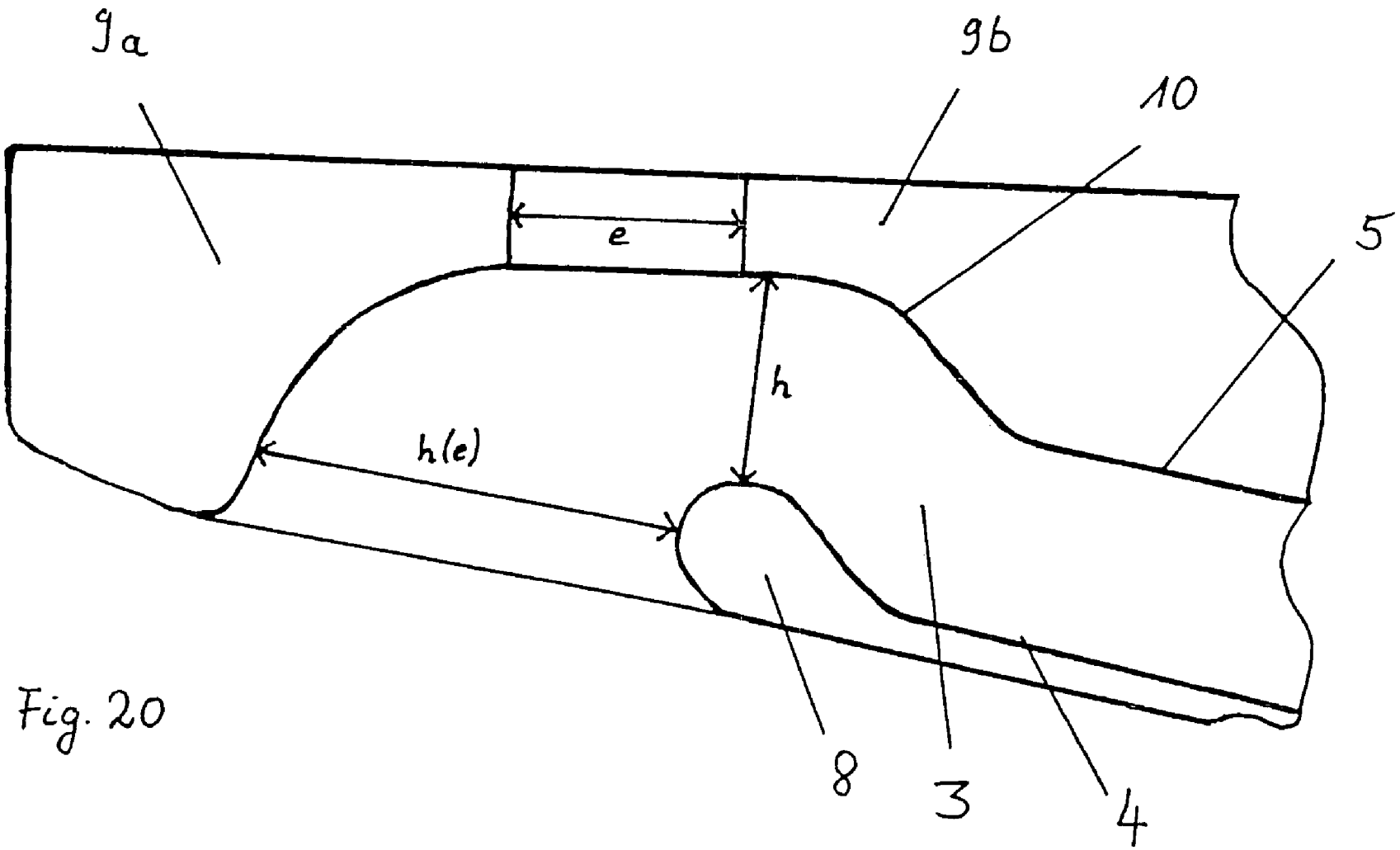
FIG. 20 illustrates a preferred configuration for the air conveying duct.

In FIG. 20, a preferred configuration of the device according to the invention is illustrated in which the forward area 9 of the top plate 5 is divided into two parts. For this purpose, the forward area 9 can be comprised of, for example, two quarter-circle arc-shaped forward partial areas, for example, a forward partial area 9*a* and a rearward partial area 9*b*. The tongue plate 15 with the forward area 9*a* can be moved, for example, parallel to the central longitudinal axis of the air conveying duct 3 about the maximum length e. The free height h in the area of the intake opening 1 is thus increased approximately by the value e to height h(e). Such a measure has only negligible effects on the flow conditions that are important in regard to the invention in the area of the height h indicated in FIG. 20. In a preferred configuration of the device according to the invention, the forward area of the upper plate can be divided into two parts. The forward area can be comprised of two, for example, quarter-circle arc-shaped areas, for example, a forward partial area and a rearward partial area. The tongue plate with the forward partial area can be pulled out, for example, parallel to the central longitudinal axis of the air conveying duct.

Figure 21:
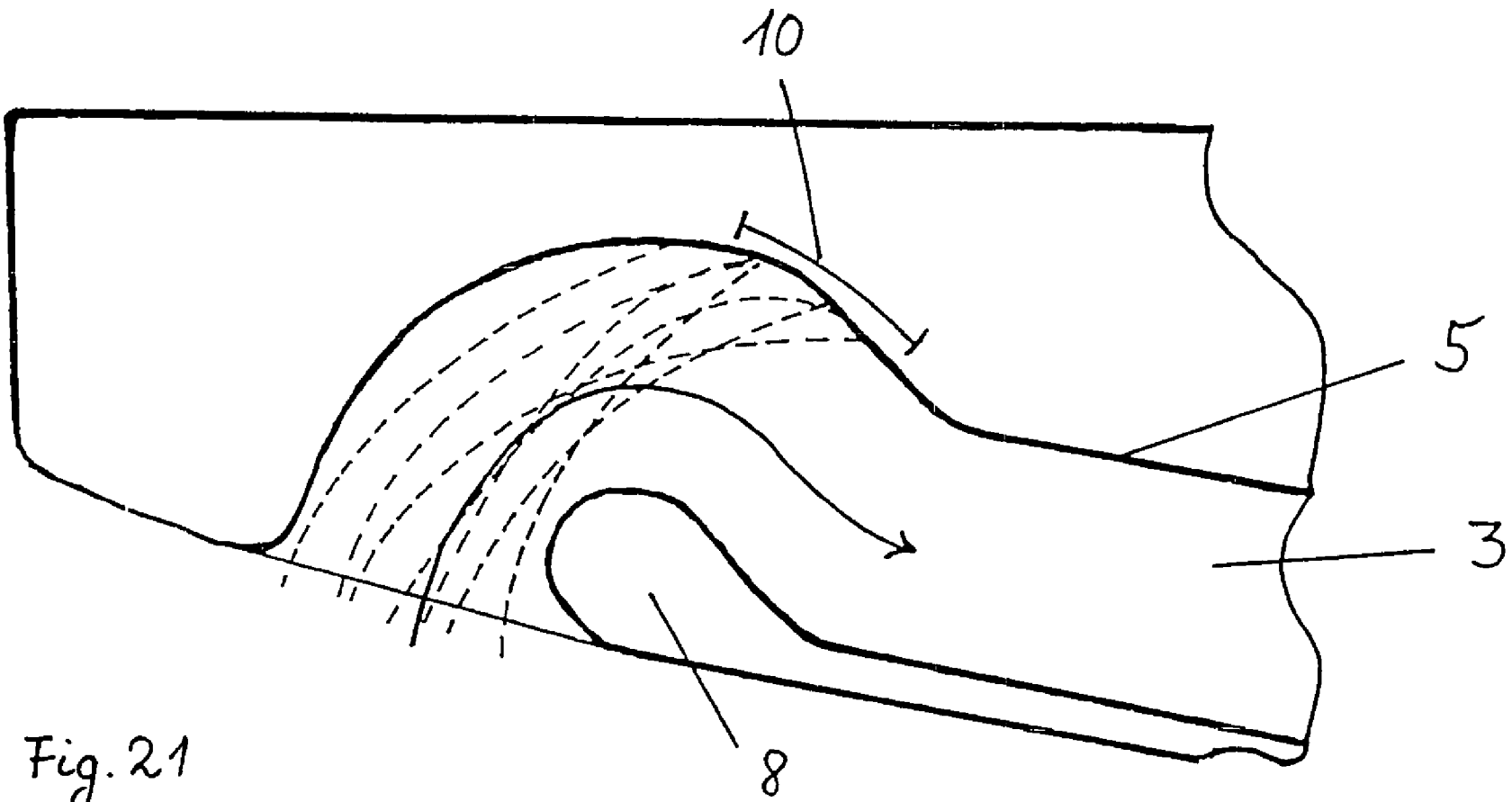
FIG. 21 shows paths of air flow and suspended particles in the air conveying duct.

In FIG. 21, different movement paths of the airflow as well as of the suspended particles over the course of the air conveying duct 3 are illustrated. While the airflow is illustrated as a continuously curved line, the different possible trajectories of the suspended particles are illustrated in dashed lines. The trajectory is affected initially by the density and three-dimensional shape of a suspended particle. Depending on how large and heavy a suspended particle is and how its outer shape is configured, an individual suspended particle can be accelerated differently by the surrounding airflow. In general, it can be stated that the suspended particles moved within the area of the inner curve—the same shape and same density provided—experience a stronger acceleration impetus than the suspended particles moved in the outer curve area. The stronger acceleration of a suspended particle moved within the inner circle at the same time increases the mass moment of inertia of the particle. A suspended particle that moves at a relatively higher speed experiences more difficulties to follow on a narrow curve radius. The faster the suspended particle moves, the stronger its movement path is aligned toward a straight movement. The situation is different for comparatively slowly moving suspended particles. Since these particles have only a minimal movement energy, the direction of these particles can be redirected easily: accordingly, such slowly moving suspended particles follow first the contour of the conveying duct 3 in the outer circle. Despite of this, the suspended particles moving on the outer circle have a different mass moment of inertia than the gaseous components of the airflow so that mandatorily during the course of flowing through the area of first deflection a trajectory will result that differs from a circular path drawn about the point of rotation P1. The cooperation of the movement energy of the suspended particles, their mass moment of inertia, and the gravitational forces acting thereon cause the suspended particles to reach inevitably, while passing through the zone of first deflection, the area of the outer airflow and to also collide inevitably as a result of their trajectory with the inner surface of the top plate 5. In this way, the top plate 5 provides a deposition surface 10 whose spatial extension is indicated by the line illustrated in FIG. 21. As shown in FIG. 21, the trajectories of suspended particles can intersect one another.

Figure 22:
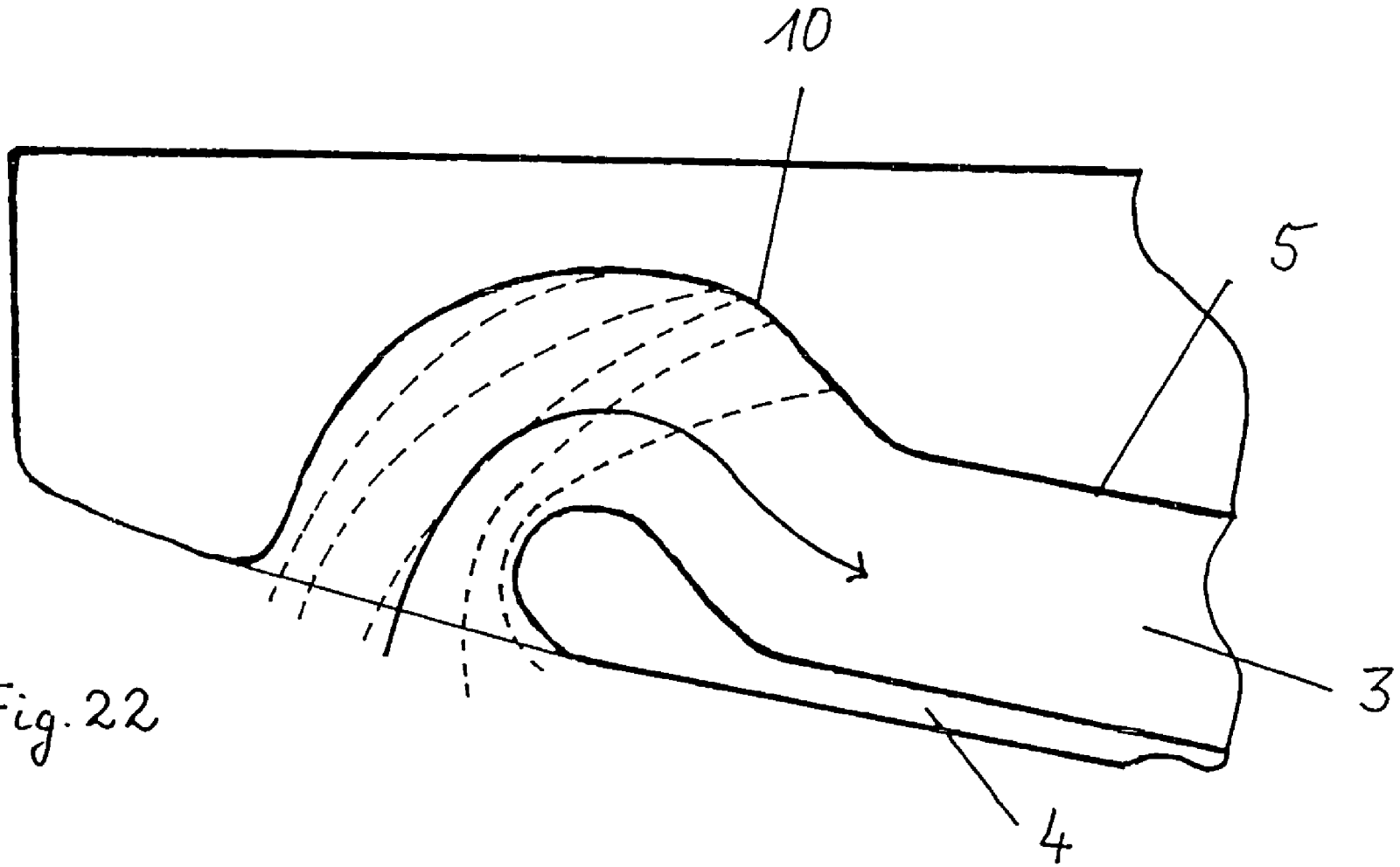
FIG. 22 shows an example where suspended particles have non-intersecting trajectories.

In FIG. 22, an example is provided in which the suspended particles have trajectories that do not intersect one another. While the suspended particles moved within the inner curve area follow initially the flow direction of the airflow and are accelerated on the inner radius, they will assume a substantially straight trajectory after having been accelerated. The suspended particles in the outer curve area follow the airflow over a longer distance, but collide in the end with the surface of the top plate 5. Whether the trajectories of the particles will intersect one another as illustrated in FIG. 21 or will extend essentially parallel as illustrated in FIG. 22, depends in the end on the concrete flow conditions in the air conveying duct 3, the density and shape of the suspended particles, the density and speed of the gases moved within the air conveying duct 3 as well as the selected radii of curvature and dimensions of the air conveying duct 3.

In order to soil only a short section of the inner surface of an air conveying duct 3 with adhering suspended particles, it is advantageous to arrange the double deflection of the airflow in a section of the air conveying duct 3 that is within the forward area when viewed in the flow direction. The removal according to the invention functions however also when the double deflection is arranged in a central or rearward section of the conveying duct 3. The intake opening 1 must not be of a rectangular configuration but can have any desired geometry. For example, it is also conceivable to provide the intake opening 1 in an annular arrangement wherein the air conveying duct 3 is comprised of a flow chamber whose exit opening is arranged centrally relative to the fan. Also, it is possible to provide several deflections according to the invention—optionally with different angles and bending radii—sequentially in series in order to be able to remove even finest particles.

What is claimed is:

1. Device for removing suspended particles from an airflow, wherein the device has an intake opening, an air conveying duct (3), and a fan, wherein the air conveying duct (3) deflects sectionally the airflow with regard to its flow direction, wherein a bottom plate (4) and a top plate (5) are spaced from one another and form between them the air conveying duct (3), the bottom plate (4) and the top plate (5) have in one section at least two sequentially arranged arc-shaped curved portions that extend sectionally at least approximately parallel to one another and are oriented opposite to one another, the forward area (9) of the top plate (5) and the forward section (8) of the bottom plate (4) delimit an intake chamber (2) with the intake opening (1); and wherein an inner plate (7) and a backplate (11) delimit laterally an exhaust chamber (6) with an outlet opening (12) which exhaust chamber is arranged downstream of the section of the air conveying duct (3) in which the positive guiding means (60) or the arc-shaped curved portions are arranged.

2. Device according to claim 1 wherein the outlet opening (12) has an oval shape.

3. Device according to claim 1 wherein the forward section (8) of the bottom plate (4) in cross-section is at least approximately of a circular arc shape.

4. Device according to claim 1 wherein the forward section (8) of the bottom plate (4) covers with its radius an angle of more than 90°.

5. Device according to claim 1 wherein the forward section (8) of the bottom plate (4) and the forward area (9) of the top plate (5) have an at least approximately concentric circle center (P1).

6. Device according to claim 1 wherein a sidewall of the air conveying duct (3) is formed as a deposition surface (10) for the suspended particles of the airflow.

7. Device according to claim 1 wherein the opposed sidewalls of the air conveying duct (3) at least over sections thereof are spaced from one another at an identical spacing.

8. Device according to claim 1 wherein at least one of the sidewalls of the air guiding duct (3) in a section thereof is configured in cross-section to have a semi-circular shape.

9. Device according to claim 1 wherein one of the sidewalls of the air conveying duct (3) is divided by forming two partial areas (9*a*, 9*b*) that are movable relative to one another.

10. Device according to claim 1 wherein a housing (21) with a fan chamber (25) for receiving the fan and with an intake chamber (23) having a lower intake opening (22) is coupled with the same to the outlet opening (12) of the exhaust chamber (6).

11. Device according to claim 10, wherein the intake chamber (23) is divided into two intake channels (24) for supplying the airflow to the fan and passes into the fan chamber (25).

12. Device according to claim 10 wherein the housing (21) is comprised of at least two housing parts (21*a*, 21*b*).

13. Device according to claim 10, wherein a tubular filter part (50) for removal of odor molecules from an airflow is connected to an exhaust opening (27) of the housing (21).

14. Device according to claim 13, wherein the tubular filter part (50) is cylindrical, having an inner hollow cylindrical distribution chamber (56), the distribution chamber (56) is delimited laterally by a first air-permeable wall (51) having formed at its outer side a layer of a filter medium (52, 53), wherein a second air-permeable wall (57) rests against the outer side of the layer (52), wherein at the outer side of the second air-permeable wall a layer of a filter medium (52, 53) is formed and a third air-permeable wall (58) rests against the outer side of this layer of the filter medium (53) and the permeable walls (51, 57, 58) have penetrations (70).

15. Device according to claim 13, wherein the airflow flows radially through the tubular filter part (50) by entering from below through a lower opening (55) into distribution chamber (56) and subsequent radial flow exits the perforated plate cylinder (51, 57, 58) and the layers (52, 53) through the perforations (70) in perforated plate cylinder (58).

16. Device for removing suspended particles from an airflow, wherein the device has an intake opening, an air conveying duct (3), and a fan, wherein the air conveying duct (3) deflects sectionally the airflow with regard to its flow direction, wherein a bottom plate (4) and a top plate (5) are spaced from one another and form between them the air conveying duct (3), the bottom plate (4) and the top plate (5) have in one section at least two sequentially arranged arc-shaped curved portions that extend sectionally at least approximately parallel to one another and are oriented opposite to one another, the forward area (9) of the top plate (5) and the forward section (8) of the bottom plate (4) delimit an intake chamber (2) with the intake opening (1); and wherein one of the sidewalls of the air conveying duct (3) is connected to the device to be foldable or removable at least over sections thereof.

17. Device for removing suspended particles from an airflow, wherein the device has an intake opening, an air conveying duct (3), and a fan, wherein the air conveying duct (3) deflects sectionally the airflow with regard to its flow direction, wherein a bottom plate (4) and a top plate (5) are spaced from one another and form between them the air conveying duct (3) the bottom plate (4) and the top plate (5) have in one section at least two sequentially arranged arc-shaped curved portions that extend sectionally at least approximately parallel to one another and are oriented opposite to one another, the forward area (9) of the top plate (5) and the forward section (8) of the bottom plate (4) delimit an intake chamber (2) with the intake opening (1); a housing (21) with a fan chamber (25) for receiving the fan and with an intake chamber (23) having a lower intake opening (22) is coupled with the same to the outlet opening (12) of the exhaust chamber (6); and wherein the housing (21) has recesses (29, 30) for receiving devices for operating the fan and/or a control.

18. Device for removing suspended particles from an airflow, wherein the device has an intake opening, an air conveying duct (3), and a fan, wherein the air conveying duct (3) deflects sectionally the airflow with regard to its flow direction, wherein a bottom plate (4) and a top plate (5) are spaced from one another and form between them the air conveying duct (3), the bottom plate (4) and the top plate (5) have in one section at least two sequentially arranged arc-shaped curved portions that extend sectional at least approximately parallel to one another and are oriented opposite to one another, the forward area (9) of the top plate (5) and the forward section (8) of the bottom plate (4) delimit an intake chamber (2) with the intake opening (1); and wherein in an air conveying duct (3) of the device a further deflection element (40) for fine removal of finest particles from the airflow is arranged.

19. Device according to claim 18, wherein the deflection element (40) has at least one module (43*a*) of at least two layers (41, 42) of cylindrical, parallel extending rods (43, 44), wherein the outer diameter D of the rods (43, 44) is identical, wherein the rods (43, 44) correlated with one layer (41, 42) are positioned at the same spacing X from one another, wherein the diagonal spacing Y is identical, and wherein the spacing X and the diagonal spacing Y are smaller than the outer diameter D of the rods (43, 44).

20. Device according to claim 19, wherein the spacing X coincides with the diagonal spacing Y.

21. Device for removing suspended particles from an air flow, wherein the device has an intake opening (1), an air conveying duct (3) and an exhaust chamber (6) connected to a fan chamber (25), the air conveying duct (3) having a bottom plate (4) and an upper plate (5), the bottom plate (4) and the upper plate (5) each having a front portion (8; 9) forming the intake opening (1) and a thereto connected intake chamber (2), and each having a middle portion (4*a*, 5*a*) forming a middle portion of the air conveying duct (3), said middle portion of the air conveying duct (3) being connected to the exhaust chamber (6), wherein the intake chamber (2) is formed such that at least some of the suspended particles carried in the air stream are deposited on the inside surface of the front portion (9) of said upper plate (5).

22. Device according to claim 21, wherein each of the front portions (8; 9) is substantially arc-shaped.

23. Device according to claim 22, wherein the front portion (8) of the bottom plate (4) is substantially three-quarter-circular and the front portion (9) of the upper plate (5) is substantially semicircular.

24. Device according to claim 23, wherein the substantially three-quarter-circular form of the front portion (8) of the bottom plate (4) and the substantially semicircular form of the front portion (9) of the upper plate (5) have a common center (P1).

25. Device according to claim 21, wherein the front portion (9) of the upper plate (5) has a first, substantially quarter-circular portion (9*a*) and a second, substantially quarter-circular portion (9*b*), and a tongue plate (15) connected to the first portion (9*a*).

26. Device according to claim 21, wherein the middle portions (4*a*; 5*a*) of the bottom plate (4) and the upper plate (5) are substantially parallel to each other.

27. Device according to claim 21, wherein the bottom plate (4) has a rear portion forming the bottom of the exhaust chamber (6).

28. Device according to claim 21, wherein the exhaust chamber (6) has an inner plate (7) connected to the middle portion (5*a*) of the upper plate (5) and a back-plate (11) to which the rear portion of the bottom plate (4) is releasably connected.

29. Device according to claim 28, wherein the rear portion of the bottom plate (4) is pivotally connected to the back-plate (11).

30. Device according to claim 28, wherein the back-plate (11) of the exhaust chamber (6) and the middle portion (4*a*) of the bottom plate (4) are disposed at an angle of substantially 80° to 90°, wherein the rear portion of bottom plate (4), said rear portion providing the bottom of the outgoing-air chamber (6), is arc-shaped.

31. Device according to claim 28, wherein the inner plate (7) of the exhaust chamber (6) and the middle portion (5*a*) of the upper plate (5) are disposed at an angle of substantially 80° to 90° and the connection between the inner plate (7) and said middle portion (5*a*) is arc-shaped.

32. Device according to claim 21, the exhaust chamber (6) has an outlet opening (12) of a length which is at least 1.5 times smaller than the length L of the intake opening (1).

33. Device according to claim 32, wherein the fan chamber (25) has an intake chamber (23) with a lower intake opening (22) and the intake opening (22) is connected to the outlet opening (12) of the exhaust chamber (6).

34. Device according to claim 33, wherein disposed in the region of the intake opening (22) is a deflection element (40) consisting of at least one module (43*a*) having at least two layers (41; 42) and a circumferential wall (49), wherein the layers (41; 42) each have a multiplicity of parallel and spaced rods (43; 44)and wherein the gaps (45) formed by the rods (43) of the one layer (41) are each covered by the rods (44) of the other layer (42).

35. Device according to claim 21, wherein the fan chamber (25) is connected to an exhaust chamber (26) having an exhaust opening (27).

36. Device according to claim 35, wherein a tubular filter portion (50) for separating odour molecules is connected to exhaust opening (27).

37. Device according to claim 35, wherein the fan chamber (25) and exhaust chamber (26) are disposed in a shell housing (21).

* * * * *